US007624553B2

(12) United States Patent
Dries

(10) Patent No.: US 7,624,553 B2
(45) Date of Patent: Dec. 1, 2009

(54) DOOR WITH INTEGRATED GRIP OR INTEGRATED FIXING ELEMENT FOR REMOVABLY FIXING GRIP

(75) Inventor: Rudi Dries, Schilde (BE)

(73) Assignee: Liexco S.A., Luxembourg (LU)

( * ) Notice: Subject to any disclaimer, the term of this patent is extended or adjusted under 35 U.S.C. 154(b) by 161 days.

(21) Appl. No.: 11/356,610

(22) Filed: Feb. 17, 2006

(65) Prior Publication Data

US 2006/0185252 A1 Aug. 24, 2006

(30) Foreign Application Priority Data

Feb. 23, 2005 (EP) ..... 05447041

(51) Int. Cl.
*E06B 1/04* (2006.01)
*E06B 3/70* (2006.01)

(52) U.S. Cl. ..... 52/455; 52/204.1; 52/207; 52/783.12; 52/784.1

(58) Field of Classification Search ..... 52/455, 52/783.1, 783.12, 784.1, 792.1, 800.12, 800.13, 52/796.1, 796.12, 797.1, 782.11, 204.1, 207, 52/210, 790.1
See application file for complete search history.

(56) References Cited

U.S. PATENT DOCUMENTS 1,010,326 A * 11/1911 Thornley ..... 52/799.12
1,104,868 A * 7/1914 Bolin ..... 52/800.13
1,138,105 A * 5/1915 Hegstedt ..... 52/690
4,094,099 A * 6/1978 Birch ..... 49/163
4,364,133 A * 12/1982 Gunter ..... 4/617
4,599,833 A * 7/1986 Bullock ..... 52/127.5
4,898,408 A * 2/1990 Hauber ..... 292/7
5,406,687 A * 4/1995 Caine ..... 29/436
5,803,145 A * 9/1998 Lamb ..... 160/90
5,887,391 A * 3/1999 Shoup ..... 52/202
6,009,932 A * 1/2000 Smith ..... 160/371
7,228,662 B1 * 6/2007 John ..... 52/204.1

(Continued)

FOREIGN PATENT DOCUMENTS

AU 2002953485 * 12/2002

(Continued)

*Primary Examiner*—Richard E Chilcot, Jr.
*Assistant Examiner*—Mark R Wendell
(74) *Attorney, Agent, or Firm*—Novak Druce + Quigg; Jerold I. Schneider

(57) ABSTRACT

The invention relates to a door comprising a door panel forming a front surface and a back surface of the door, and a grip integrated into the door panel and extending from the front surface up to the back surface of the door panel, the grip being shaped to enable users to open/close the door. The grip extends over substantially an entire dimension of the front and back surfaces and divides the door panel into separate door panel segments extending on opposite sides of the grip. The invention further relates to an assembly comprising a door and at least one interchangeable grip, the door comprising a door panel forming a front surface and a back surface of the door, and a fixing element integrated into the door panel and extending from the front surface up to the back surface of the door panel, the fixing element being provided for removably fixing the at least one interchangeable grip. The fixing element extends over an entire dimension of the front and back surfaces and divides the door panel into separate door panel segments extending on opposite sides of the fixing element.

5 Claims, 24 Drawing Sheets

U.S. PATENT DOCUMENTS

| | | | | |
|---|---|---|---|---|
| 7,350,555 | B2 * | 4/2008 | Qing | 160/90 |
| 7,448,668 | B2 * | 11/2008 | Brabeck et al. | 296/146.1 |
| 2004/0112552 | A1 | 6/2004 | Rooth | |
| 2006/0202506 | A1 * | 9/2006 | Brabeck et al. | 296/146.1 |

FOREIGN PATENT DOCUMENTS

| | | | |
|---|---|---|---|
| DE | 200 00 335 | U1 | 3/2000 |
| DE | 200 22 936 | U1 | 8/2002 |
| EP | 1 205 627 | A | 5/2002 |
| FR | 2 769 039 | A | 4/1999 |

* cited by examiner

DOOR WITH INTEGRATED GRIP OR INTEGRATED FIXING ELEMENT FOR REMOVABLY FIXING GRIP

CROSS-REFERENCE TO RELATED APPLICATIONS

This application claims priority from European Patent Application No. 0544704.1, filed Feb. 23,2005, which is hereby incorporated by reference.

TECHNICAL FIELD

The present invention relates to a door comprising a door panel and a grip integrated into the door panel. The invention further relates to an assembly comprising a door and at least one interchangeable grip, the door comprising a door panel and a fixing element integrated into the door panel for fixing the at least one interchangeable grip.

BACKGROUND ART

From JP-A-2004076507 a door with an integrated grip is known which comprises a door panel forming a front surface and a back surface of the door, and a grip integrated into the door panel. The grip extends from the front surface up to the back surface and is shaped to enable users to open/close the door. The grip is integrated into an opening in the door panel.

The door known from JP-A-2004076507 has the disadvantage that there is a risk of tearing of the material of the door panel, especially at the corners of the opening surrounding the grip, as a result of one or more of the following causes: different thermal expansion coefficients of the door panel material and the grip material, expansion of the door panel material by humidity, strong forces exerted on the grip, or other.

DISCLOSURE OF THE INVENTION

It is an aim of the present invention to provide a door with an integrated grip with which the risk of tearing may be reduced.

This aim is achieved according to the invention with a door comprising a door panel and a grip integrated into the door panel, wherein the door panel comprises front and back panels which are fixed together at their peripheral edges by reveal parts, the front and back panels respectively forming a front surface and a back surface of the door, wherein the grip extends from the front surface up to the back surface of the door panel and is shaped to enable users to open/close the door, wherein the grip is a substantially straight oblong profile with a continuous cross-section which extends over substantially an entire dimension of the front and back surfaces and divides the door panel into separate door panel segments extending on opposite sides of the grip, and wherein the profile of the grip has stepped portions at the front and back for receiving edges of the front and back panels.

In the door according to the invention, the grip, shaped to enable users to open/close the door, is integrated into the door panel and extends from the front surface up to the back surface, so throughout the entire thickness of the door panel. The grip further extends over an entire dimension of the front and back surfaces, e.g. over the entire width or the entire height or slanting, and divides the door panel into separate door panel segments extending on opposite sides of the grip, so e.g. an upper and a lower door panel segment or a left hand and a right hand door panel segment. Because of the fact that the grip extends over an entire dimension of the front and back surfaces and divides the door panel into separate segments, the grip is not surrounded by the door panel material as in the prior art. Consequently, dilatation of the door segments as a result of temperature variations and/or humidity is unhampered by the grip and will only cause a slight unevenness in the surface of the reveal sides of the door panel. Furthermore, since the grip extends up to the sides of the door panel, forces exerted on the grip are transferred via a larger contact area, reducing the risk of tearing or damaging the door panel.

Furthermore, the fact that the grip extends over an entire dimension, dividing the door panel into door panel segments which are fixed to each other by the grip, it is easy from a constructional point of view to have a door panel comprising door panel segments of different materials or colours, e.g. a glass segment above and a wooden or metal segment below. This creates an enormous flexibility in the design of the door of the invention, both aesthetically and functionally: the user can create colour combinations at will or adapt the rigidity and transparency of the door according to his needs.

The integration of the grip into the door panel means that substantially no part of the grip protrudes from the front and back surfaces of the door. This has a number of advantages over usual, protruding grips and handles. For example, for a turning door in a corner of a room, the grip does not strike the adjacent wall of the corner when the door is swung open, so damage is prevented, and the door can open over a full 90°. For a sliding door, the grip does not prevent the complete sliding of the door behind an adjacent door panel or wall. The integrated grip also has the advantage that it may be prevented that users hurt themselves or damage their clothes on the grip and that it does not form a hindrance for trolleys, hospital beds and the like. In short, a protruding grip is often struck by passing objects or persons, which may lead to the grip coming loose from the door panel and requires a lot of maintenance.

In the door of the invention, the door panel comprises front and back panels, fixed together at their peripheral edges by reveal parts, and the grip is formed by a profile having stepped portions at the front and back for receiving edges of the front and back panels. These stepped portions are shaped complementary to the panel edges and can thus ensure a solid connection between the grip and the panels. Furthermore, the stepped shape has the effect that the grip extends partly between the front and back panels, forming an additional reinforcement. Still further, the stepped shape has the effect that the front and back panels cover the grip almost completely from eyesight, apart from a narrow space at the front/back surface of the door which can be just wide enough to accommodate one's hand, which can lead to an aesthetically pleasing look of the door of the invention.

The grip is preferably formed by a substantially straight, oblong profile. This profile extending from one side of the door up to the other, or from top to bottom, has the advantage that a grippable part is available to users over the entire width/height of the door. In case of a vertical mounting, tall people as well as small children have a grippable part on their own height. The straightness of the profile has the advantage that the contact surface with the door panel does not show corners or bends where there could be a higher risk of tearing. So this further reduces the risk of tearing or damaging the door panel. However, the grip may also be formed by a curved or angled profile.

In a preferred embodiment, the grip profile extends in substantially horizontal direction and is located at a predetermined height for serving as bumper for trolleys, hospital beds etc. So in this embodiment, the functionality of the grip is enhanced and the need for a separate bumper on the door is obviated, which may lead to a door having fewer construction parts. Furthermore, the horizontal grip profile at this height is very useful for wheel chair patients, who have a grippable part over the entire width of the door. In the case of a sliding door which may be both opened towards the right and the left, the horizontal grip profile over the entire width has the advantage that always a grip is accessible to the user.

In order to provide good grippability for users, the grip preferably has a front, resp. back opening which widens from the front, resp. back surface towards the middle of the door panel. This may be accomplished by upstanding ridges at the front and back surfaces or in any other way deemed suitable by the person skilled in the art.

In a preferred embodiment of the invention, which is especially suitable for thin doors, the grip has front and back openings which are superposed with respect to each other. By the superposition, the front opening may extend up to the back surface and the back opening up to the front surface, so that even in thin doors sufficient space is provided for achieving good grippability.

In another embodiment of the invention, the grip may be formed by a front part and a back part, separated from each other by an isolating material attached to both the front part and the back part. This embodiment is advantageous in case a good thermal isolation between two rooms is desired.

The door may be a sliding door or a turning door. In the latter case the door is on one side provided with a hinge and on the other side provided with a releasable positioning element which holds the door in closed position until force is applied for opening the door. The use of this releasable positioning element can avoid the need for a protruding handle on the door. The positioning element may for example be a magnetic strip, a roller system or a jamb lining according to EP-B-645517, which is incorporated by reference.

It is further an aim of the present invention to provide a door with an integrated fixing element for at least one interchangeable grip.

This further aim is achieved according to the invention with an assembly comprising a door and at least one interchangeable grip, wherein the door comprises a door panel and a fixing element integrated into the door panel, wherein the door panel comprises front and back panels which are fixed together at their peripheral edges by reveal parts, the front and back panels respectively forming a front surface and a back surface of the door, wherein the fixing element extends from the front surface up to the back surface of the door panel and is provided for removably fixing the at least one interchangeable grip, wherein the fixing element is a substantially straight oblong profile with a continuous cross-section which extends over substantially an entire dimension of the front and back surfaces and divides the door panel into separate door panel segments extending on opposite sides of the fixing element, and wherein the profile has stepped portions at the front and back for receiving edges of the front and back panels.

In the door assembly of the invention, a fixing element is integrated into the door panel and extends from the front surface up to the back surface of the door panel. The fixing element is provided for removably fixing the at least one interchangeable grip. The fixing element further extends over an entire dimension of the front and back surfaces, e.g. over the entire width or the entire height or slanting, and divides the door panel into separate door panel segments extending on opposite sides of the fixing element, so e.g. an upper and a lower door panel segment or a left hand and a right hand door panel segment. Because of the fact that the fixing element extends over an entire dimension of the front and back surfaces and divides the door panel into separate segments, the fixing element offers the same advantages as the grip in the first aspect of the invention, apart from those associated with a non-protruding grip or handle. Here, there is however the advantage of interchangeability of grips and their location anywhere on the grip profile as desired by the user.

In the door assembly of the invention, the door panel comprises front and back panels, fixed together at their peripheral edges by reveal parts, and the fixing element is formed by a profile having stepped portions at the front and back for receiving edges of the front and back panels. These stepped portions have are shaped complementary to the panel edges and can thus ensure a solid connection between the fixing element and the panels. Furthermore, the stepped shape has the effect that the fixing element extends partly between the front and back panels, forming an additional reinforcement. Still further, the stepped shape has the effect that the front and back panels cover the fixing element almost completely from eyesight, apart from a narrow space at the front/back surface of the door which can be just wide enough to accommodate the interchangeable grips, which can lead to an aesthetically pleasing look of the door of the invention.

The fixing element is preferably formed by a substantially straight, oblong profile. This profile extending from one side of the door up to the other, or from top to bottom, has the advantage that the interchangeable grips can be mounted by the users over the entire width/height of the door. In case of a vertical mounting, a grip can be mounted for tall people as well as small children on their own height. The straightness of the profile has the advantage that the contact surface with the door panel does not show corners or bends where there could be a higher risk of tearing. So this further reduces the risk of tearing or damaging the door panel. However, the fixing element may also be formed by a curved or angled profile.

In a preferred embodiment, the fixing element profile extends in substantially horizontal direction and is located at a predetermined height for serving as bumper for trolleys, hospital beds etc. So in this embodiment, the functionality of the fixing element is enhanced and the need for a separate bumper on the door is obviated, which may lead to a door having fewer construction parts.

In a preferred embodiment, the fixing element is in itself constructed as a grip, so that the user can further select between a door with just the fixing element as grip or a door with an additional (protruding) grip mounted on a desired location on the fixing element.

In order to provide good grippability for users, the fixing element preferably has a front, resp. back opening which widens from the front, resp. back surface towards the middle of the door panel. This may be accomplished by upstanding ridges at the front and back surfaces or in any other way deemed suitable by the person skilled in the art.

In a preferred embodiment of the invention, which is especially suitable for thin doors, the fixing element has front and back openings which are superposed with respect to each other. By the superposition, the front opening may extend up to the back surface and the back opening up to the front surface, so that even in thin doors sufficient space is provided for fixing an interchangeable grip.

In another embodiment of the invention, the fixing element may be formed by a front part and a back part, separated from each other by an isolating material attached to both the front part and the back part. This embodiment is advantageous in case a good thermal isolation between two rooms is desired.

The door may be a sliding door or a turning door. In the latter case the door is on one side provided with a hinge and on the other side provided with a releasable positioning element which holds the door in closed position until force is applied for opening the door. The use of this releasable positioning element can avoid the need for a protruding handle on the door. The positioning element may for example be a magnetic strip, a roller system or a jamb lining according to EP-B-645517, which is incorporated by reference.

For fixing the interchangeable grips to the fixing element, complementary fixing means are provided, which are preferably formed by a pair of recesses on opposite sides of the grip and recess engaging members which are slidably mounted in a sleeve of the fixing element. The recess engaging members are provided with fixing means, such as for example a fixing screw, for fixing the members on the fixing element once they are in their recess engaging position, thereby fixing the grip on the door. The fixing of the grip on the fixing element may however also be carried out in any other way known to the person skilled in the art. Optionally, multiple fixing means may be provided on the fixing element, so that multiple interchangeable grips can be fixed at the same time.

The invention is most advantageous upon application in the field of chamber doors and interior doors or, more generally, substantially parallelepiped shaped doors which form a separation between two rooms. However, the invention may also be applied in other fields, such as for example doors of cabinets, closets and other cupboards, doors towards the exterior or any other doors.

BRIEF DESCRIPTION OF THE DRAWINGS

The invention will be further elucidated by means of the following description and the appended figures.

MODES FOR CARRYING OUT THE INVENTION

Figure 1:
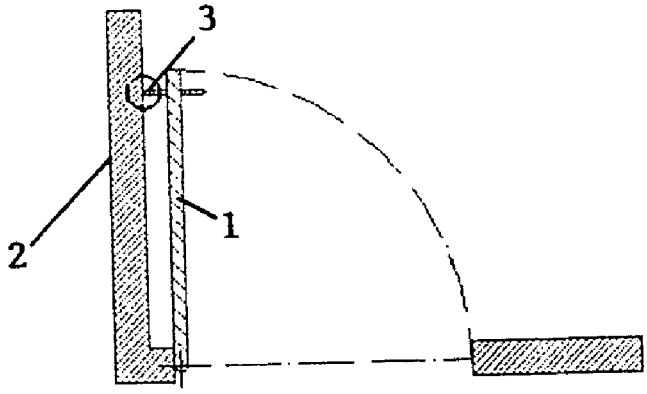
FIGS. 1-10 show problems which may arise with conventional doors with protruding handles.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

The term "comprising", used in the claims, should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Figure 9:
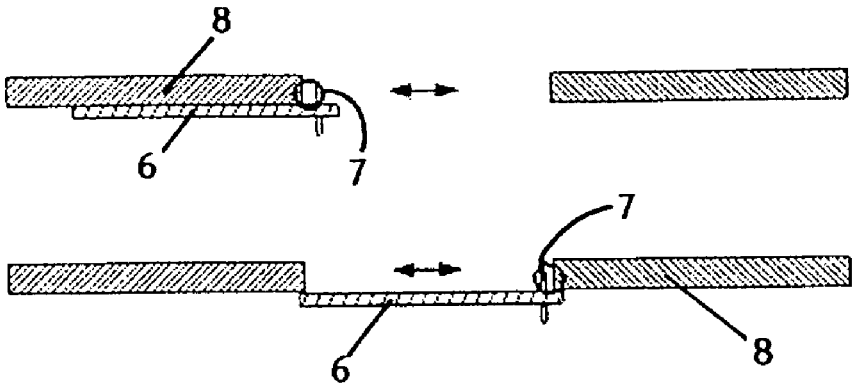
Figure 10:
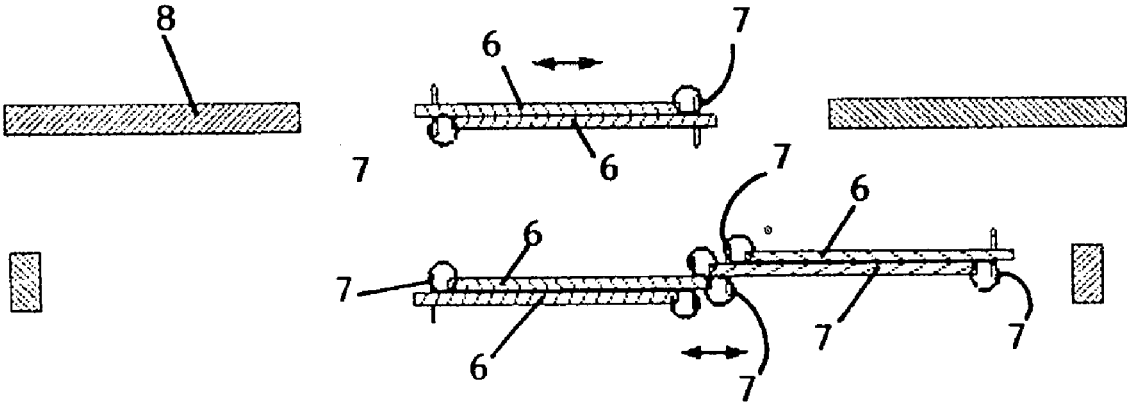

The problems which may arise with protruding or non-integrated handles or grips are clarified by means of FIGS. 1-10, of which FIGS. 1-8 relate to turning doors and FIGS. 9-10 relate to sliding doors. The specific area where the problem occurs is each time indicated by a circle.

Figure 2:
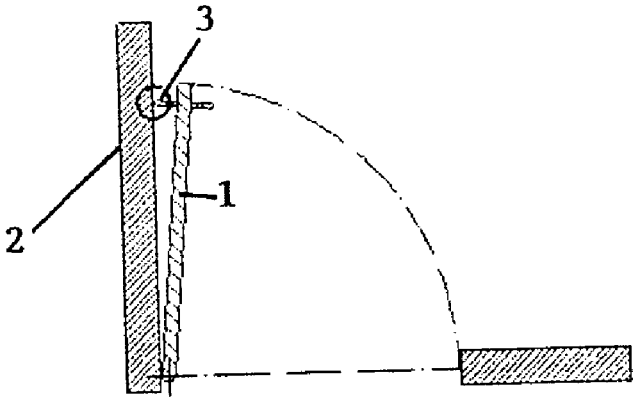
Figure 3:
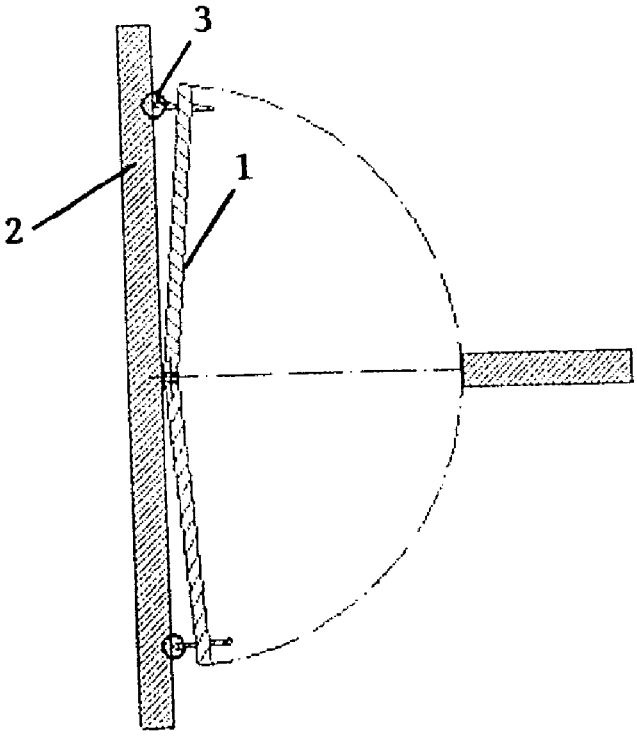
Figure 4:
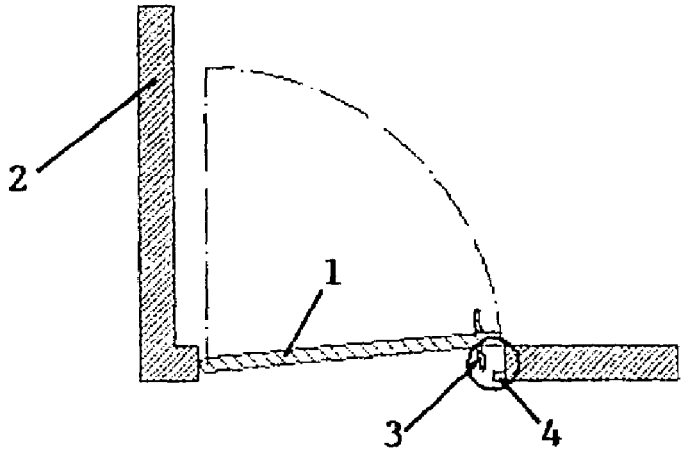
Figure 5:
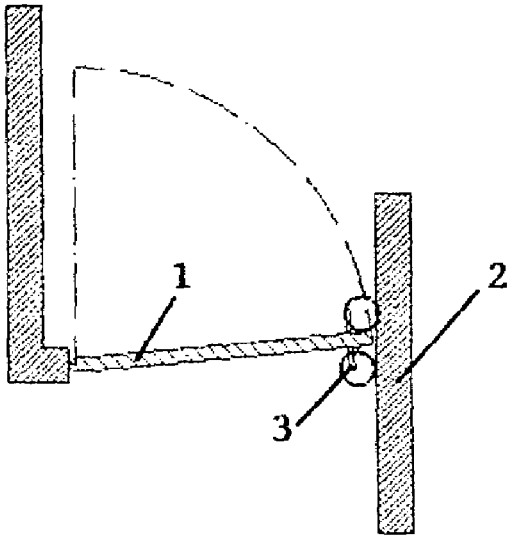
Figure 6:
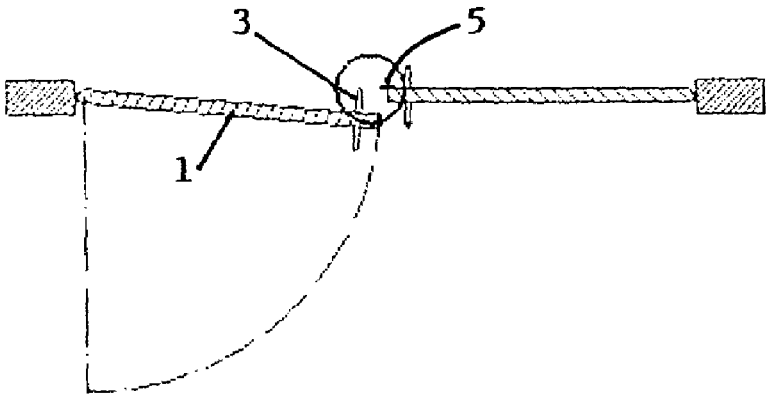
Figure 7:
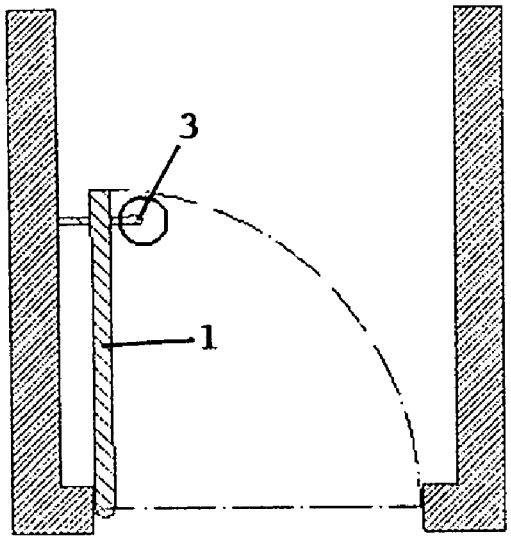
Figure 8:
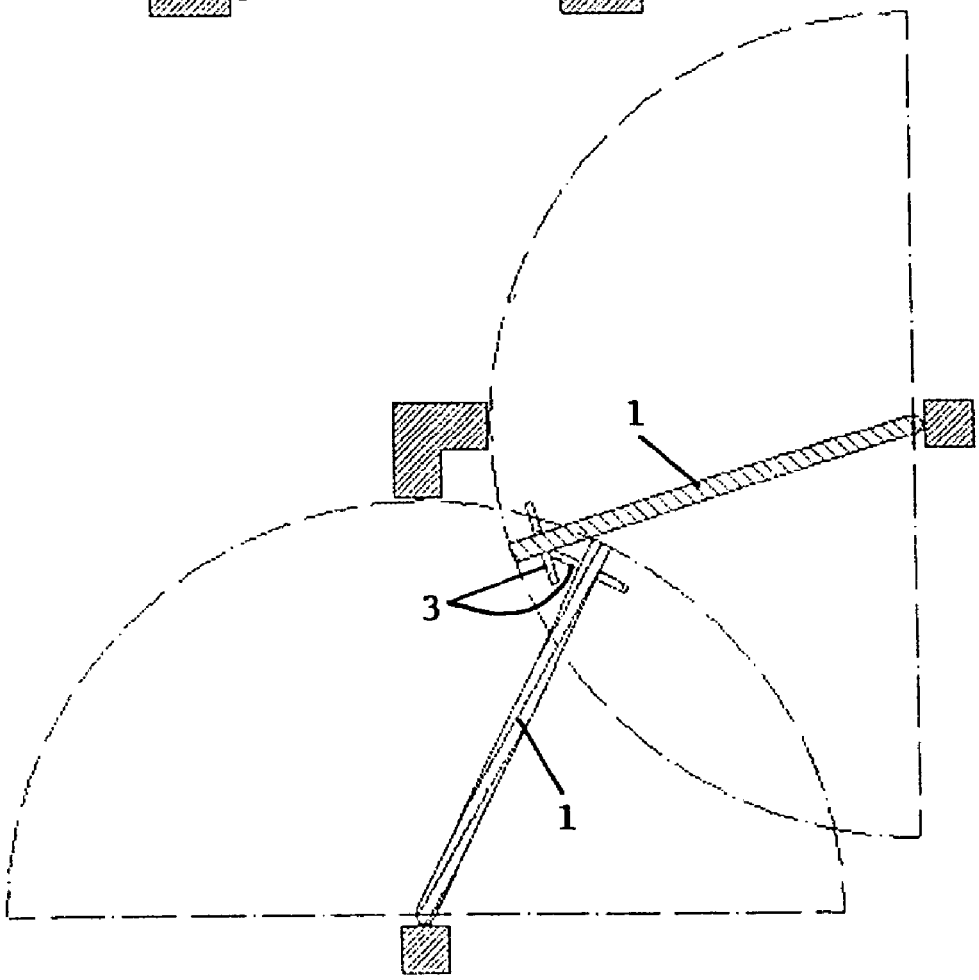

In FIG. 1, it is indicated that a protruding handle 3 of a turning door 1 mounted in a room corner may strike and cause damage to the wall 2. FIG. 2 indicates that the handle 3 may further hamper the door 1 from being opened a full 90°. FIG. 3 indicates that the problems of FIGS. 1 and 2 may occur on both sides of the door 1, when it can be opened to both sides. Furthermore, when holding the handle 3 while closing the door 1, a user can hurt his hand on a door stile 4 as indicated in FIG. 4, or on a wall 2 as indicated in FIG. 5, or on an opposite post 5 of a double door as indicated in FIG. 6. The handle 3 on the other side may also cause problems: it may hinder passing objects (hospital beds, trolleys etc.) or damage clothes of passing users as indicated in FIG. 7, or two doors may hook into each other in the extreme situation of FIG. 8.

For sliding doors, there is also the aspect of a user hurting his hand on a wall 8 while holding the handle 7 of the sliding door 6 upon opening or closing the door, as indicated in FIG. 9. In the case of double or multiple sliding doors (e.g. a wall made up entirely of sliding door panels) as shown in FIG. 10, the risk of hurting one's hand is also present between a handle 7 of one door 6 and the end of an adjacent door 6. Furthermore, the handles 7 form obstructions for the door panels 6.

None of the problems of FIGS. 1-10 occur with the doors according to the invention of FIGS. 11-18.

Figure 11:
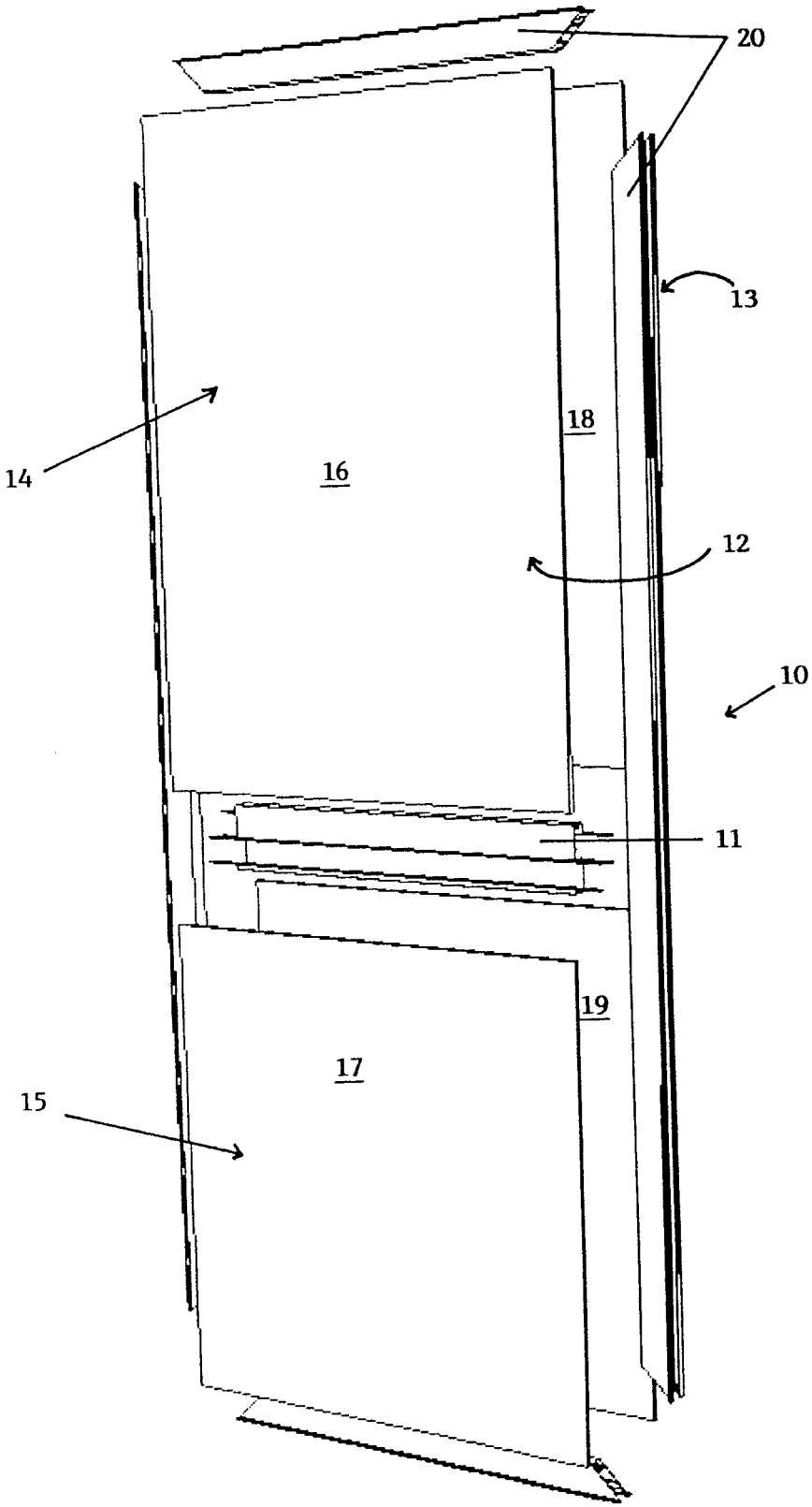
FIG. 11 shows an exploded view of a first embodiment of a door according to the first aspect of the invention.

The door of FIG. 11 comprises a door panel 10 with an integrated grip 11, i.e. substantially non-protruding from the front and back surfaces 12, 13 of the door panel 10. The integrated grip 11 extends over substantially the entire width of the door panel 10 and divides it into an upper door panel segment 14 and a lower door panel segment 15. These are in turn respectively formed by upper front and back panels 16, 18 and lower front and back panels 17, 19. All these panels 16-19 are assembled with the grip 11 in between and with a frame of reveal parts 20 surrounding them to form a hollow, parallelepiped shaped door panel 10 with integrated grip 11. In this way, the door panel 10 can conveniently be constructed in few steps from a small number of parts.

The panels 16-19 may be constructed in wood, glass, metal, plastics or any other material known to the person skilled in the art. The grip 11 and the frame 20 are preferably constructed in metal or plastics, but any other material known to the person skilled in the art may also be used. Optionally, the hollow spaces in the door panel 10 between the front and back panels may be filled with any kind of filling material, such as for example an isolation material in case a good thermal or sound isolation is desired, or a fire retardant material in fire doors, or any other filler known to the person skilled in the art. The upper and lower segments 14, 15 may also be formed by solid panels in wood, glass (e.g. double or multiple glazing), metal, plastics or any other material known to the person skilled in the art. The attachment of the constituent parts can be performed by means of adhesive or bonding, or by means of fixing elements (not shown), or in any other way known to the person skilled in the art.

Figure 12A:
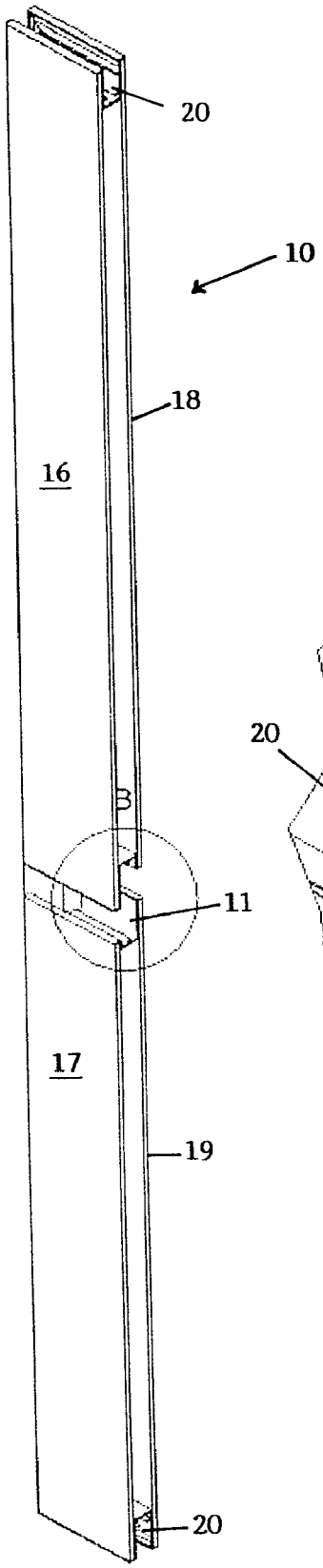
FIG. 12 shows a cross sectioned perspective view of the embodiment of FIG. 11 in assembled state.
Figure 12B:
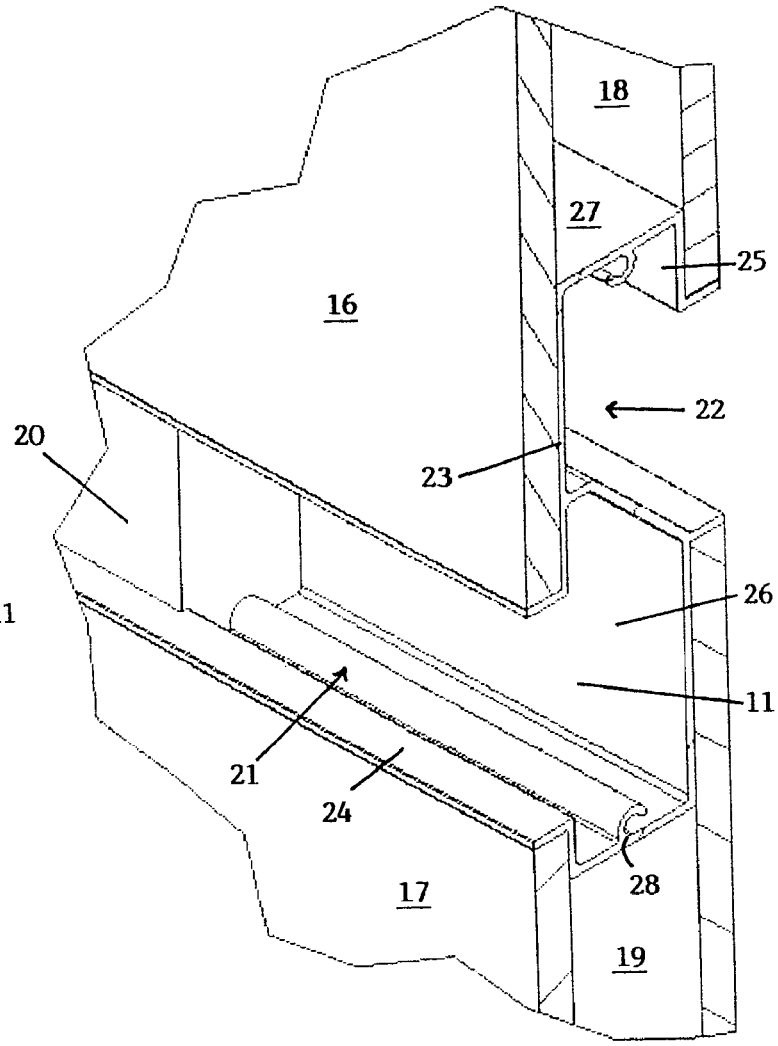

As can be seen in FIG. 12, the grip 11 is formed by a straight, oblong profile which shows a front opening 21 and a back opening 22 which are superposed with respect to each other to provide the maximum depth as space for the user's hand. Both the front and back openings 21, 22 are narrow at the surface and widen towards the middle of the grip profile 11. In order to make good contact with the different front and back panels 16-19, the profile has stepped portions 23-26 which each have a horizontal portion for contacting the edge of the panel 16-19 and a vertical portion for contacting a rear side of the panel 16-19. These stepped portions 23-26 are made as large as possible for maximising the contact area with the panels 16-19. As can be seen in FIG. 12*b*, the contact areas of the stepped portions 23, 26 for the upper front panel 16 and the lower back panel 26 are larger than those of the stepped portions 24 and 25. This shape of the profile with the stepped portions 23-26 also has the advantage that the profile has an upper part 27 and the lower part 28 extending in between the respective front and back panels, so the profile forms a reinforcement for the door panel 10.

Figure 13:
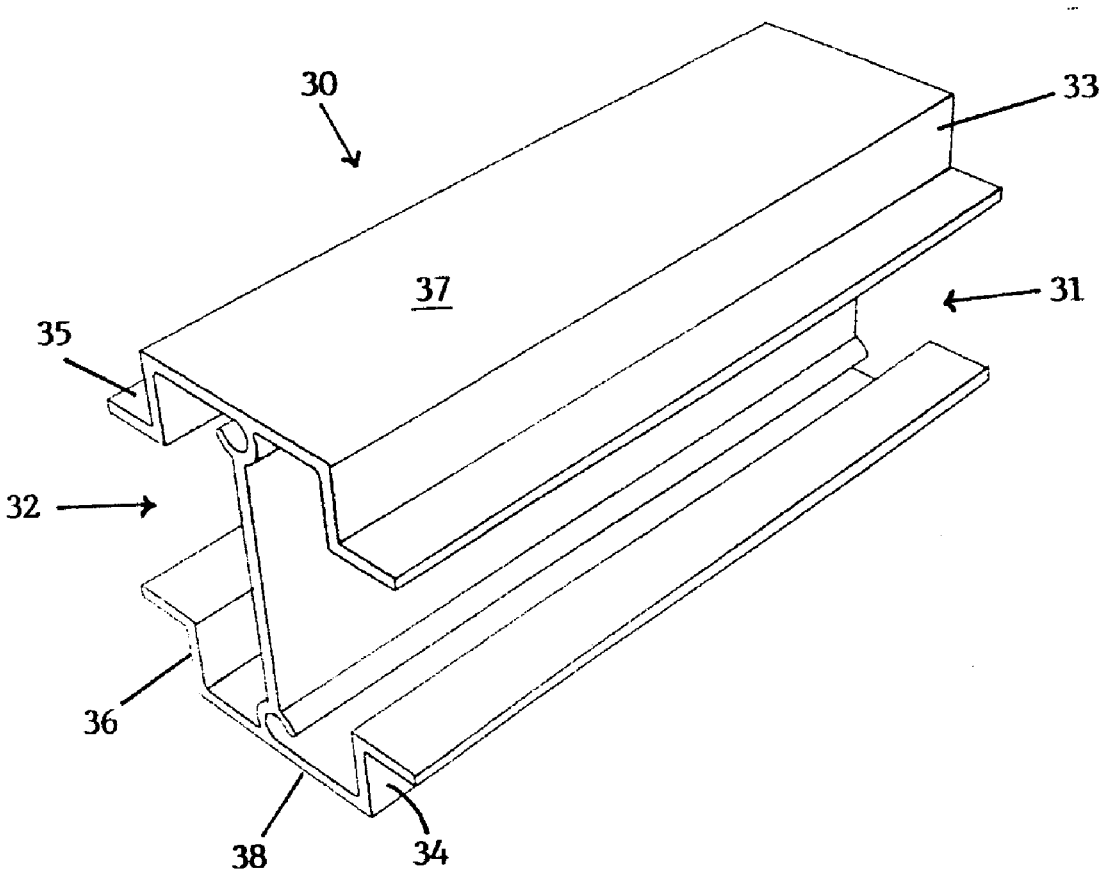
FIG. 13 shows a perspective view of a preferred embodiment of a grip profile according to the first aspect of the invention.

FIG. 13 shows an alternative embodiment of a grip profile 30. This profile also comprises stepped portions 33-36, complementary to the edges of front and back panels of the door panel, and upper and lower parts 37, 38 which end up in between front and back panels and form a reinforcement. The grip profile 30 mainly differs in that the front and back openings 31, 32 are on the same height, i.e. not superposed with respect to each other. They each extend from the front/back up to a middle wall 39 of the profile 30. Both are again narrower at the front/back, widening towards the middle. In case a good thermal or sound isolation is desired, a profile (not shown) similar to that of FIG. 13 can be used with separate front and back portions between which a suitable isolation material is provided.

Figure 14A:
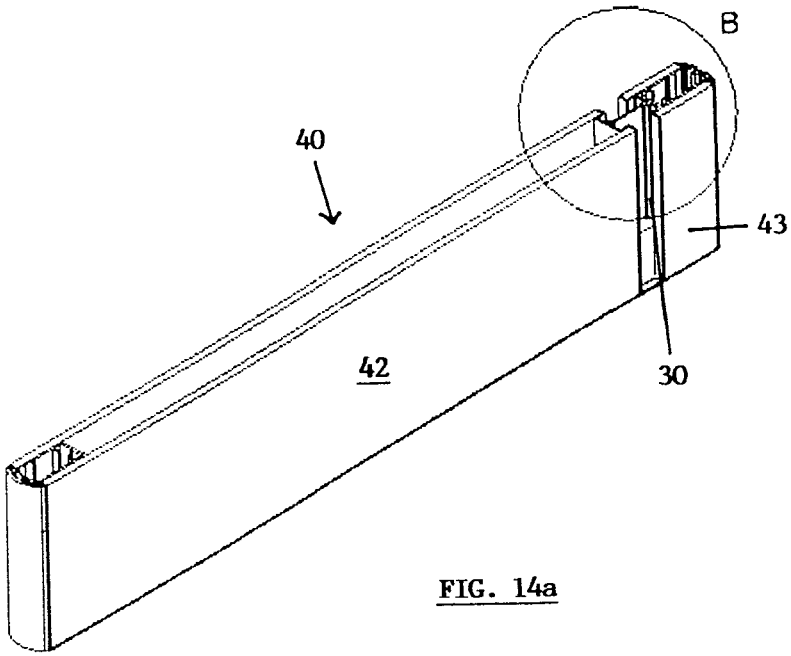
FIG. 14 shows a cross sectioned perspective view of a door with the grip of the embodiment of FIG. 13 in assembled state.
Figure 14B:
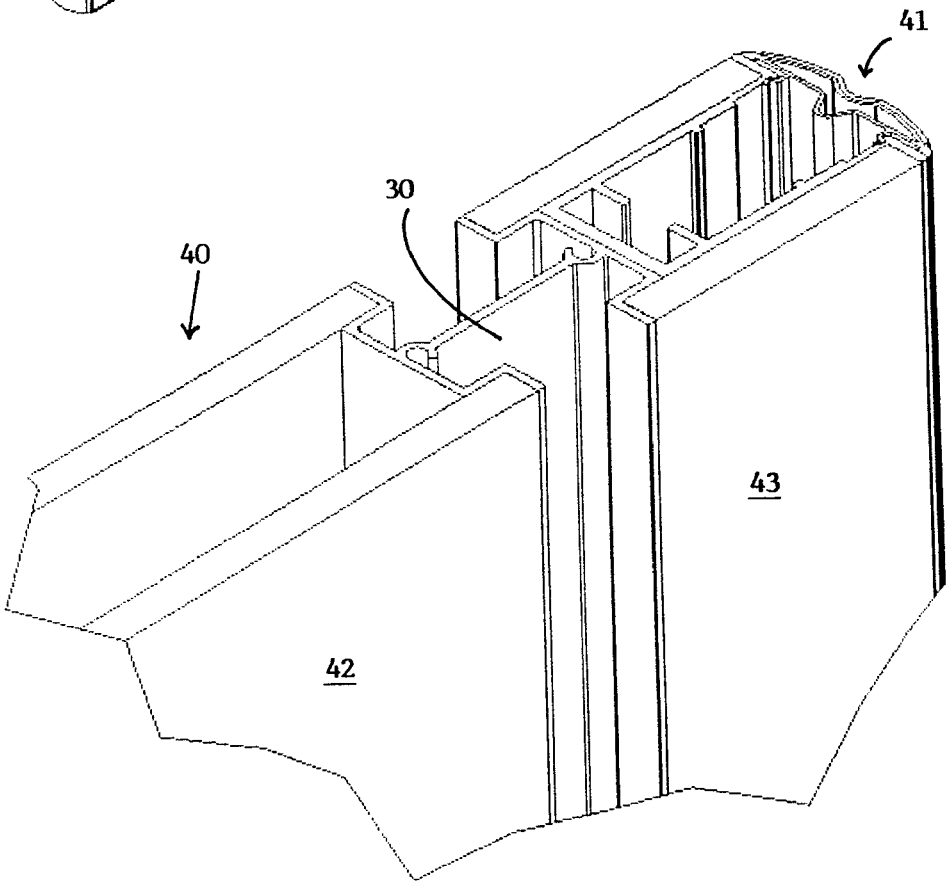

FIG. 14 shows the incorporation of the grip profile 30 of FIG. 13 into a door panel 40 in vertical orientation, dividing the latter into a left hand segment 42 and a right hand segment 43. The principle is the same as has been described above with respect to FIGS. 11 and 12 and will therefore not be repeated here. FIG. 14 further shows the combinability of this invention with the jamb lining 41 of EP-B-645517, which function as a releasable positioning element holding the door 40 in closed position as long as no or insufficient force is applied to push/pull the door 40 open.

Figure 15:
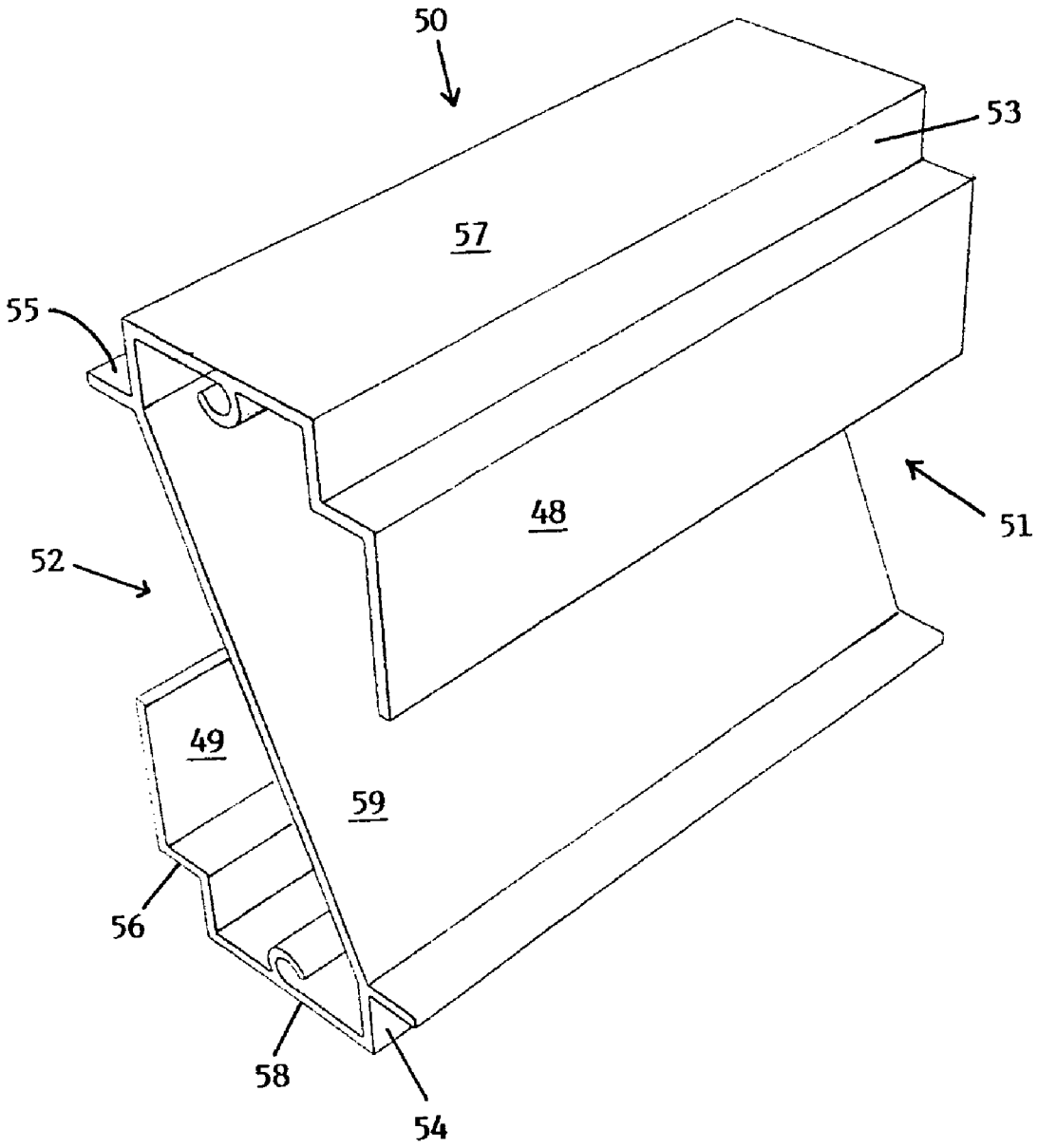
FIG. 15 shows a perspective view of a preferred embodiment of a grip profile according to the first aspect of the invention.
Figure 16A:
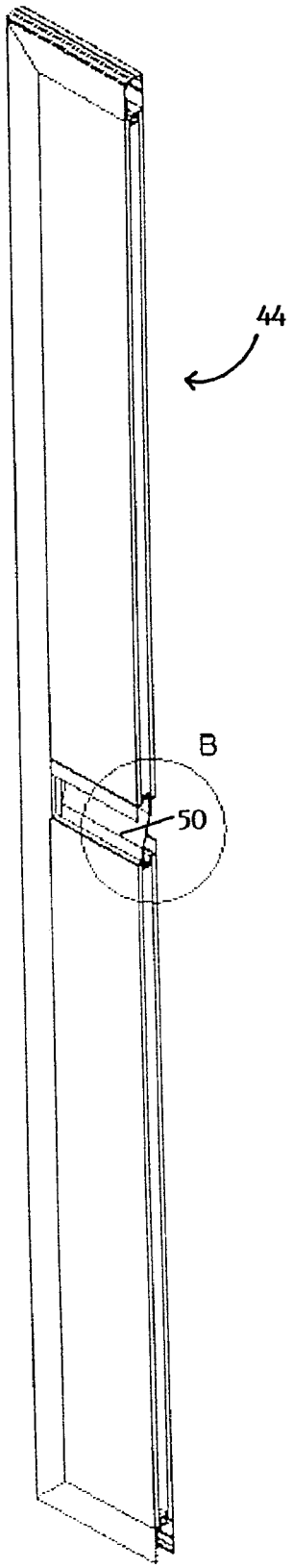
FIG. 16 shows a cross sectioned perspective view of a door with the grip of the embodiment of FIG. 15 in assembled state.
Figure 16B:
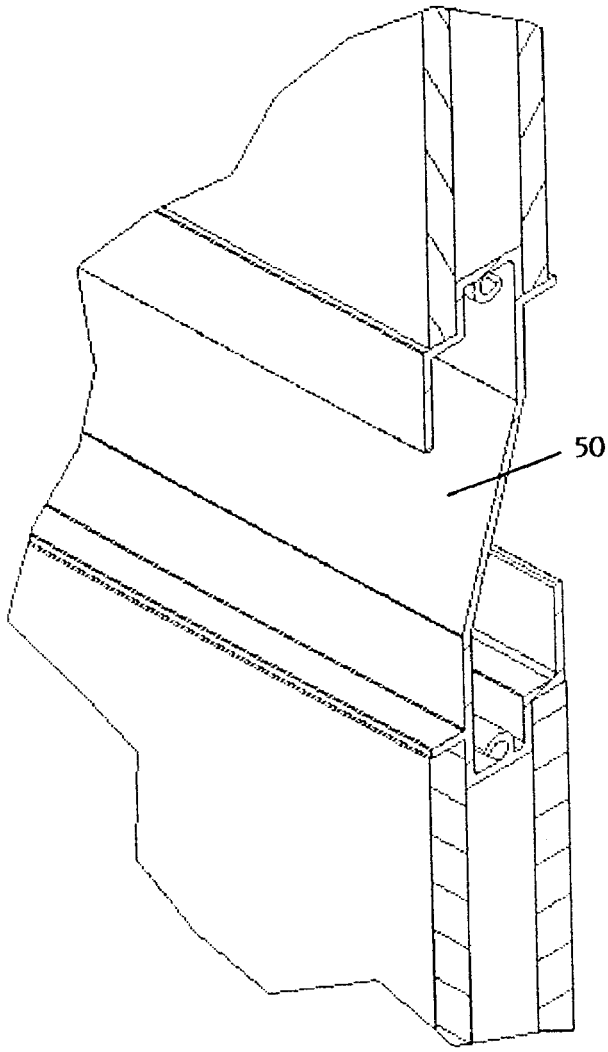

FIG. 15 shows another alternative embodiment of a grip profile 50. This profile also comprises stepped portions 53-56, complementary to the edges of front and back panels of the door panel, and upper and lower parts 57, 58 which end up in between front and back panels and form a reinforcement. In this grip profile 50 the front and back openings 51, 52 are again somewhat superposed with respect to each other. They each extend from the front/back up to a slanting middle wall 59 of the profile 30. Both are again narrower at the front/back, widening towards the middle.

A particular feature of this grip profile 50 is that both at the front and at the back a substantially vertical ridge 48, 49 is provided, which in use slightly protrudes from the front/back surface of the door panel 44 and can thus function as a bumper for hospital beds, trolleys etc. This is apparent from FIG. 16*b*. The grip profile 50 is mounted on a predetermined height in the door panel 44 in horizontal direction, to achieve this functionality as bumper.

Figure 17:
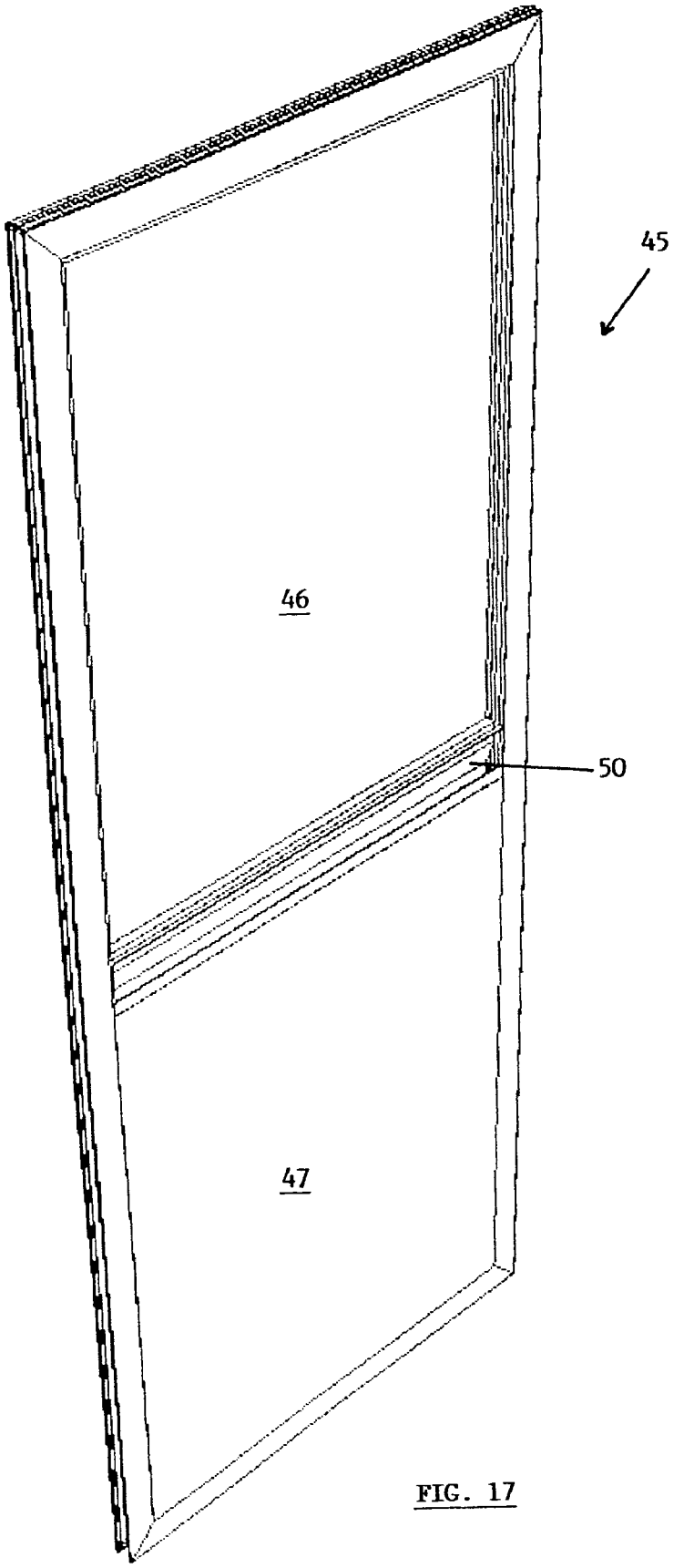
FIG. 17 shows a complete perspective view of the door of FIG. 16.
Figure 18:
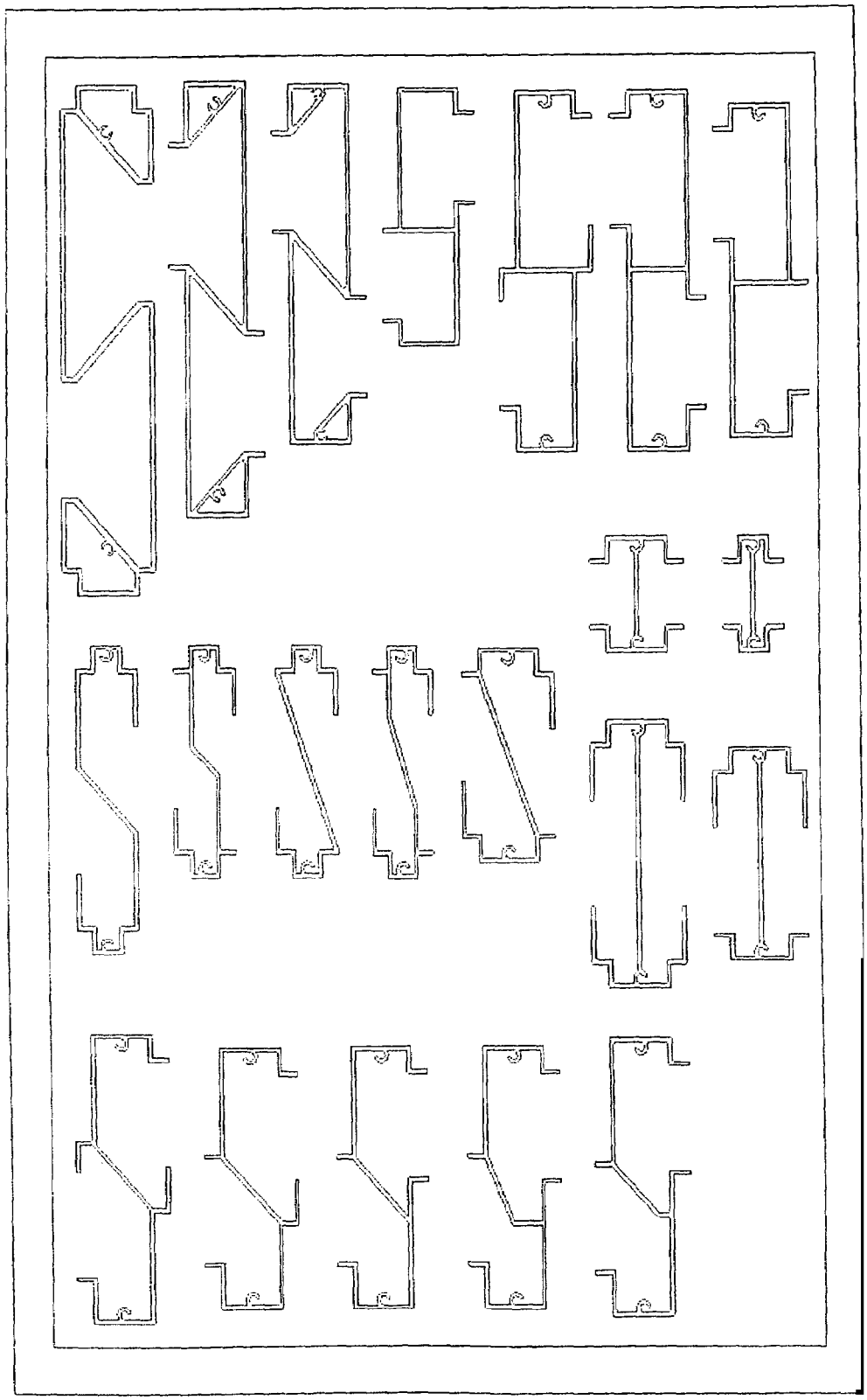
FIG. 18 shows in cross section a set of alternative embodiments of grip profiles according to the first aspect of the invention.

In order to illustrate the flexibility of the door panel design of the invention, FIG. 17 shows the use of the grip profile 50 of FIG. 15 in a door panel 45 with a transparent upper segment 46 and a non-transparent lower segment 47. FIG. 18 shows a plurality of variant grip profiles.

Figure 19:
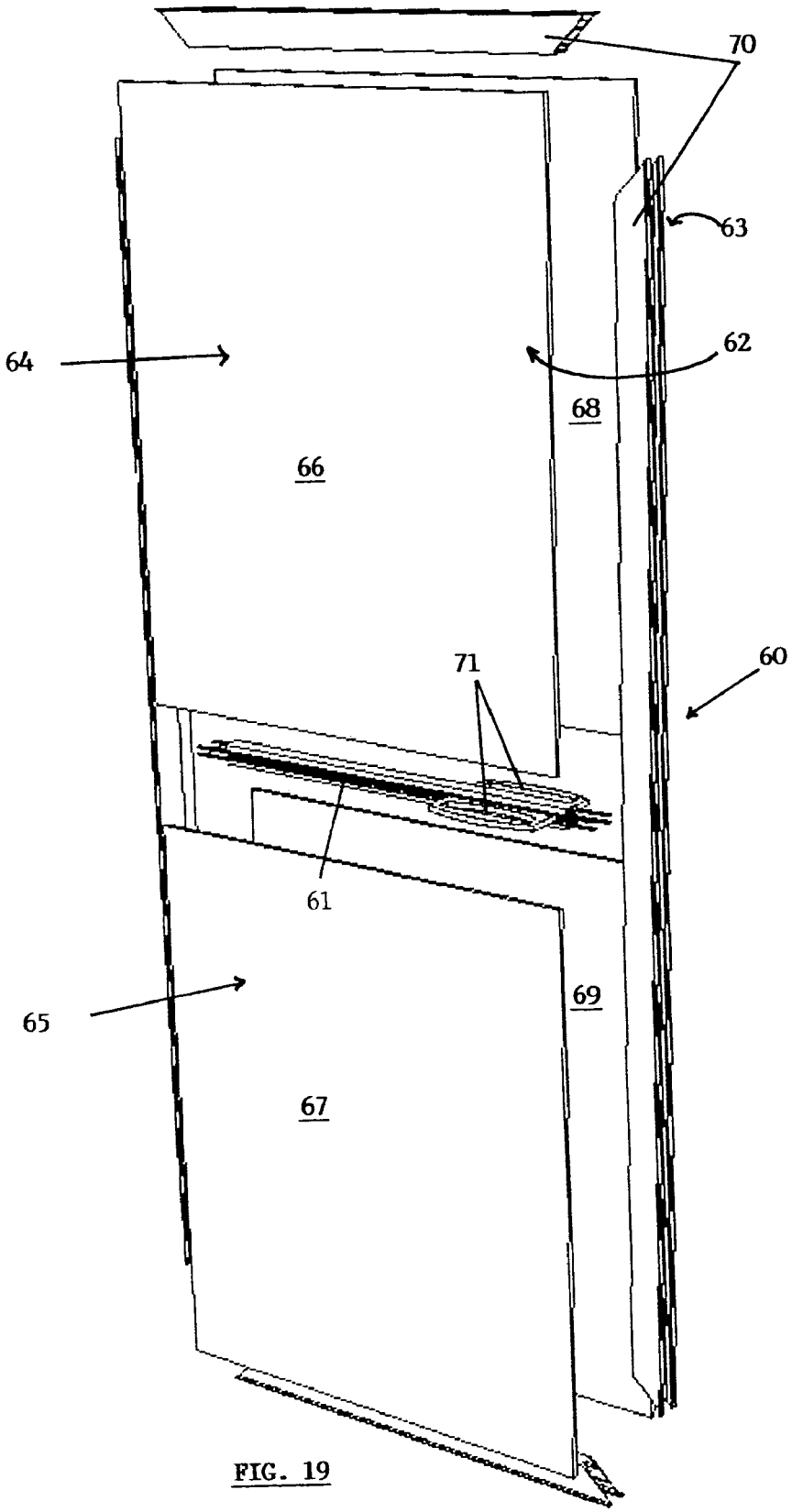
FIG. 19 shows an exploded view of a first embodiment of a door assembly according to the second aspect of the invention.

The door assembly of FIG. 19 comprises a door panel 60 with an integrated fixing element 61, i.e. substantially non-protruding from the front and back surfaces 62, 63 of the door panel 60. The integrated fixing element 61 extends over substantially the entire width of the door panel 60 and divides it into an upper door panel segment 64 and a lower door panel segment 65. These are in turn respectively formed by upper front and back panels 66, 68 and lower front and back panels 67, 69. All these panels 66-69 are assembled with the fixing element 61 in between and with a frame of reveal parts 70 surrounding them to form a hollow, parallelepiped shaped door panel 60 with integrated fixing element 61. In this way, the door panel 60 can conveniently be constructed in few steps from a small number of parts.

The panels 66-69 may be constructed in wood, glass, metal, plastics or any other material known to the person skilled in the art. The fixing element 61 and the frame 70 are preferably constructed in metal or plastics, but any other material known to the person skilled in the art may also be used. Optionally, the hollow spaces in the door panel 60 between the front and back panels may be filled with any kind of filling material, such as for example an isolation material in case a good thermal or sound isolation is desired, or a fire retardant material in fire doors, or any other filler known to the person skilled in the art. The upper and lower segments 64, 65 may also be formed by solid panels in wood, glass (e.g. double or multiple glazing), metal, plastics or any other material known to the person skilled in the art. The attachment of the constituent parts can be performed by means of adhesive or bonding, or by means of fixing elements (not shown), or in any other way known to the person skilled in the art.

Figure 20:
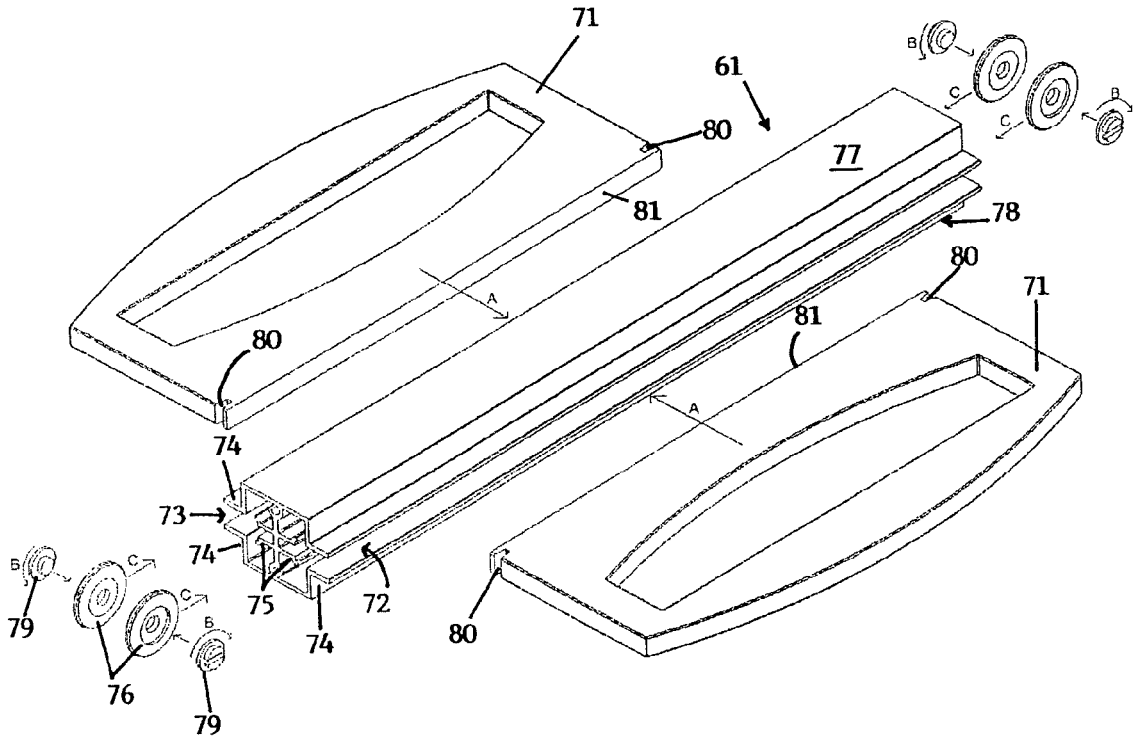
FIG. 20 shows an exploded view of a preferred embodiment of a fixing element with interchangeable grip according to the second aspect of the invention.
Figure 21:
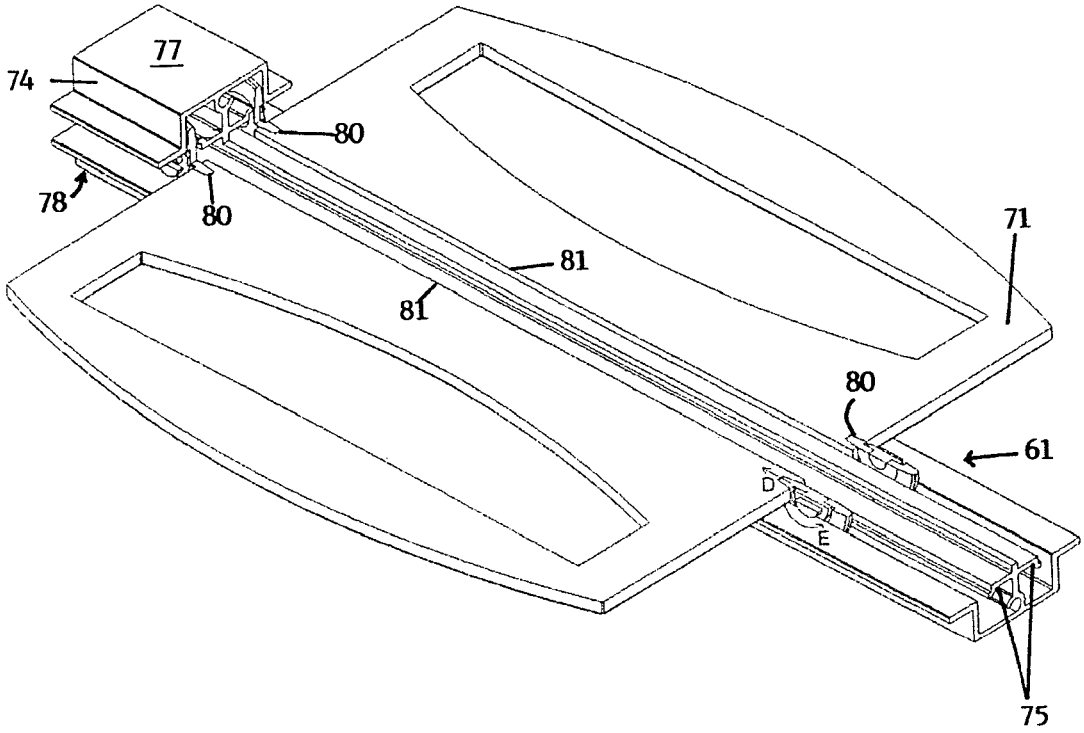
FIG. 21 shows a perspective view of the embodiment of FIG. 20 in assembled state.
Figure 22B:
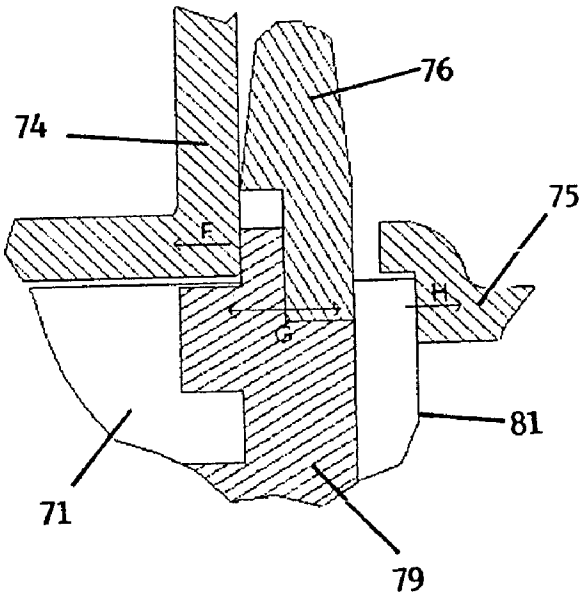
FIG. 22 shows a cross section of the embodiment of FIG. 20 in assembled state.
Figure 22A:
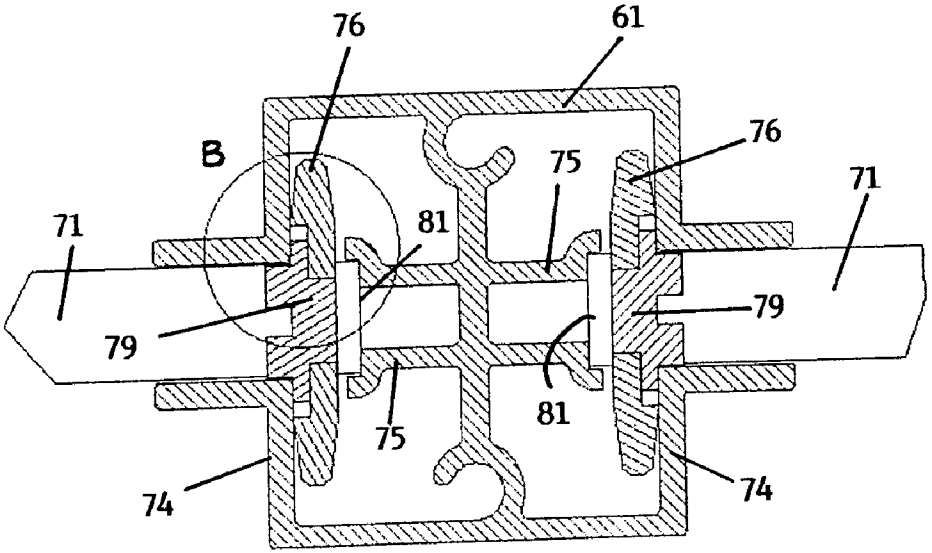

As can be seen in FIGS. 20-22, the fixing element 61 is formed by a straight, oblong profile which shows a front opening 72 and a back opening 73 at the same height, i.e. non-superposed with respect to each other. Both the front and back openings 72, 73 are narrow at the surface and widen towards the middle of the fixing element 61. In order to make good contact with the different front and back panels 66-69, the profile has stepped portions 74 which each have a horizontal portion for contacting the edge of the panel 66-69 and a vertical portion for contacting a rear side of the panel 66-69. These stepped portions 74 are made as large as possible for maximising the contact area with the panels 66-69. This shape of the profile with the stepped portions 74 also has the advantage that the profile has an upper part 77 and the lower part 78 extending in between the respective front and back panels, so the profile forms a reinforcement for the door panel 60.

The fixing element 61 and the grips 71 have complementary fixing means, formed by a pair of recesses 80 on opposite sides of each grip 71 and recess engaging members 76 which are slidably mounted in a sleeve of the fixing element 61. For assembly of the grips 71 into the fixing element 61, the grip is inserted into the front/back opening 72/73 until the back side 81 abuts the abutment parts 75 which are provided in the interior of the profile of the fixing element 61. Then, the recess engaging members 76 are brought into position, i.e. they are slid in the interior of the profile until they are in the desired position, engaging the recesses 80 of the grip 71. Finally, the grip is secured by tightening the fixing screws 79, which releasably fix the position of the recess engaging members 76 with respect to the fixing element 61. In this assembled state, the back side 81 of the grip 71 abuts the abutment parts 75 and the recess engaging members 76 abut the stepped portions 74 of the profile, so that the grip 71 is tightly clamped into the profile 61, ensuring a good long term fixing of the grip 71.

Figure 23:
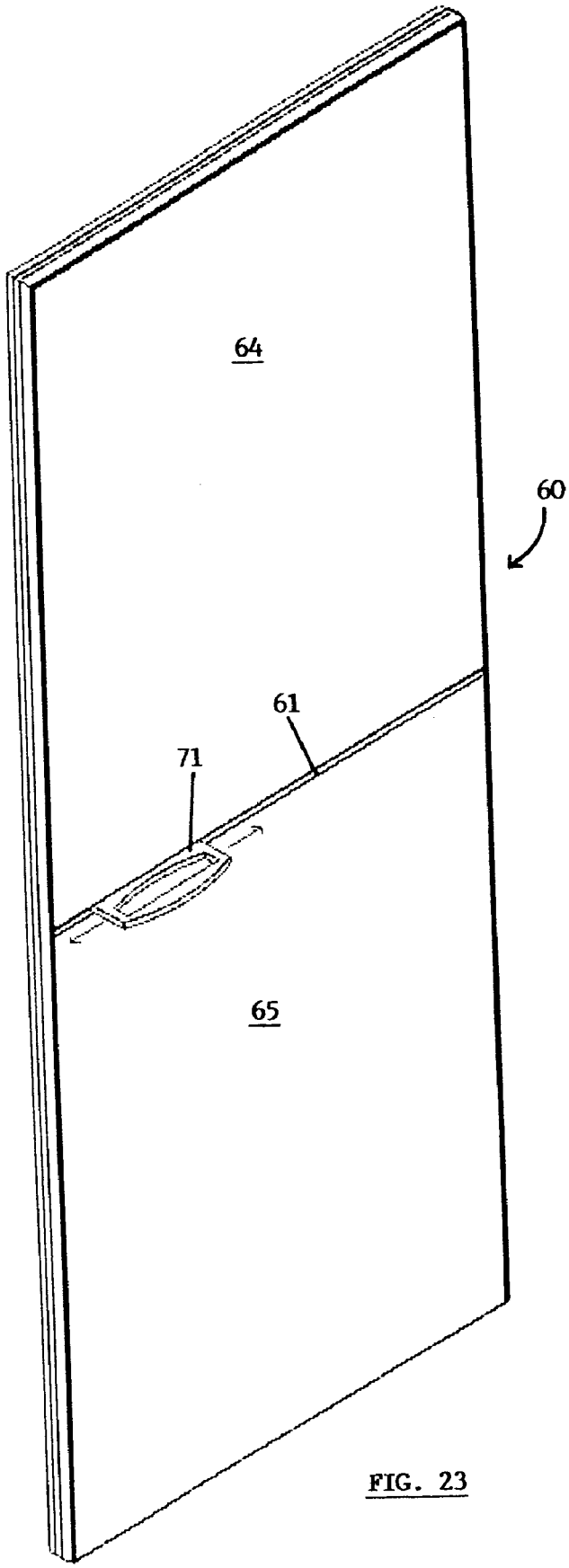
FIGS. 23 and 24 shows alternative embodiments of door assemblies according to the second aspect of the invention.
Figure 24:
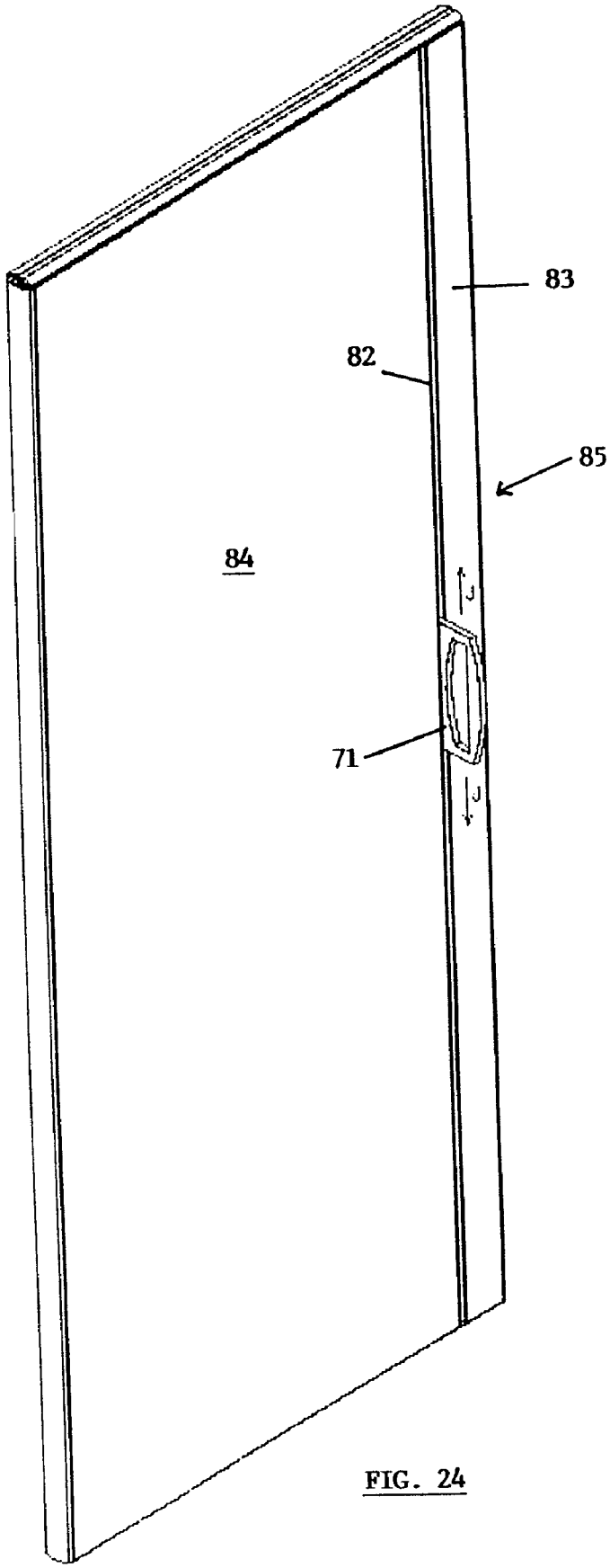
Figure 25:
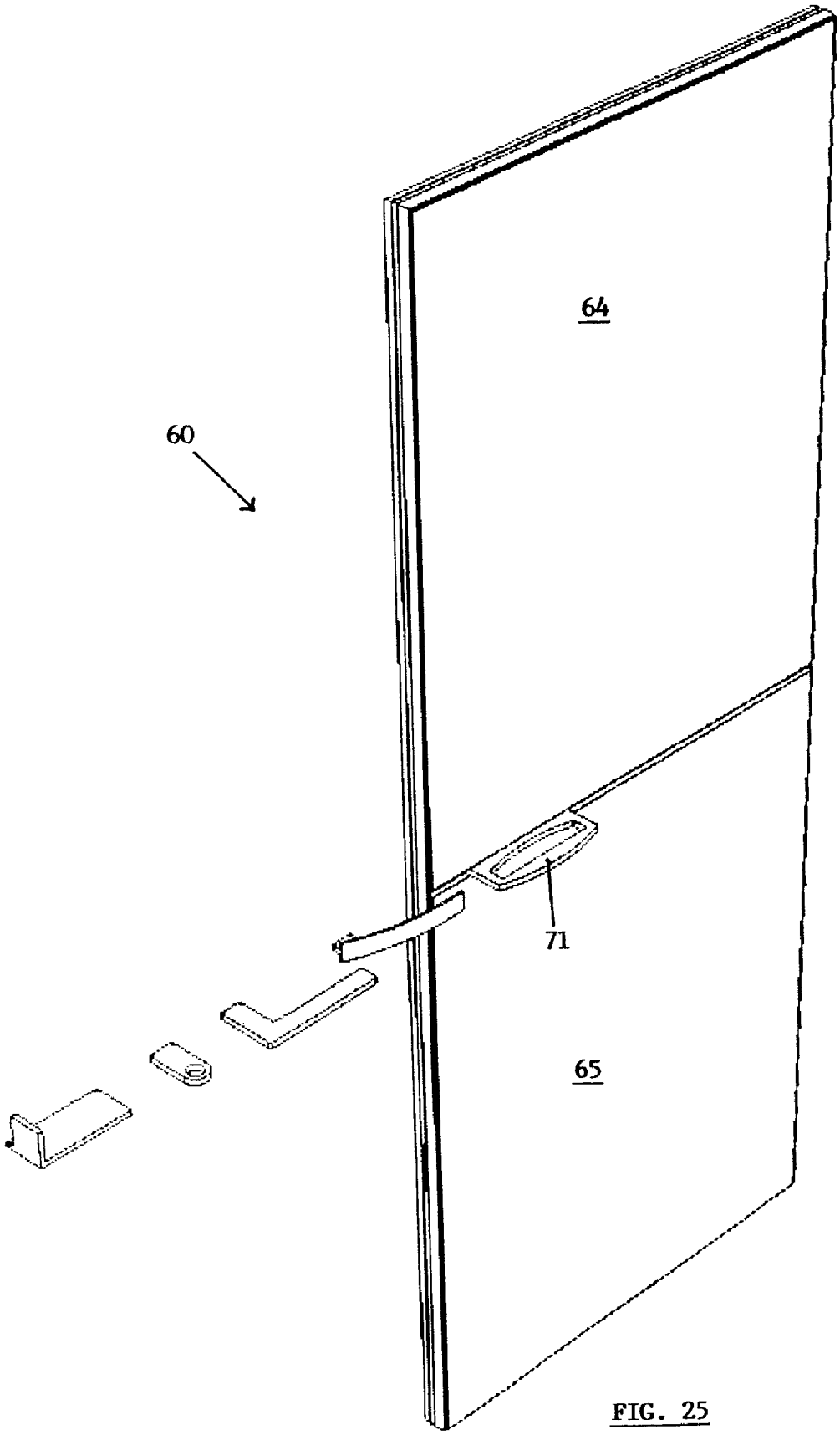
FIG. 25 illustrates a number of interchangeable grips according to the second aspect of the invention.

Because of the slidability of the recess engaging members 76, which are applied on opposite sides of the grip 71, the grip 71 can be positioned anywhere along the length of the profile 61, as illustrated in FIG. 23 for a horizontal orientation of the fixing element and in FIG. 24 for a vertical orientation of the fixing element. Also the distance between the two recess engaging members 76 fixing one grip 71 can be adjusted to the width of the grip 71, making the assembly system suitable for a large number of interchangeable grips 71 as is for example shown in FIG. 25.

Figure 26B:
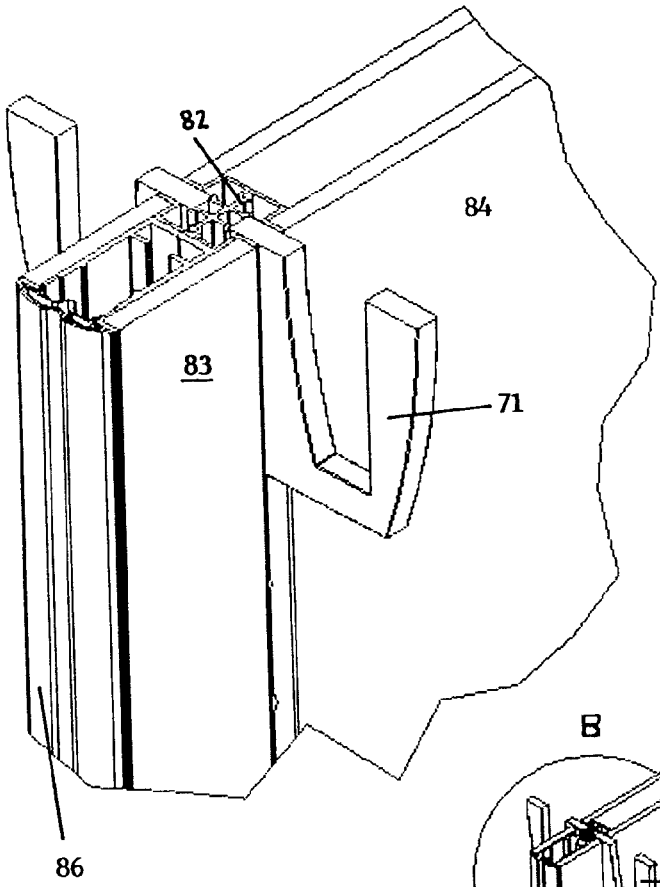
FIG. 26 shows a cross sectioned perspective view of the embodiment of FIG. 24.
Figure 26A:
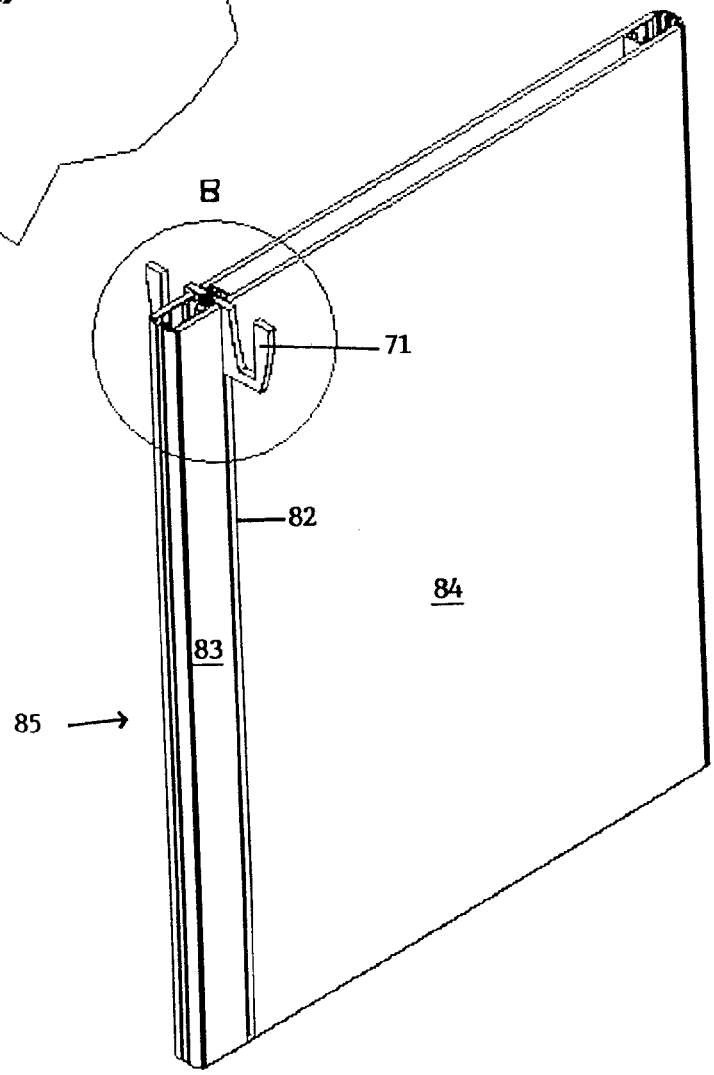

FIG. 26 shows the incorporation of a fixing element 82 having the same profile of that of FIGS. 20-22 into a door panel 85 in vertical orientation, dividing the latter into a left hand segment 83 and a right hand segment 84. The principle is the same as has been described above with respect to FIGS. 20-22 and will therefore not be repeated here. FIG. 26 further shows the combinability of this invention with the jamb lining 86 of EP-B-645517, which function as a releasable positioning element holding the door 85 in closed position as long as no or insufficient force is applied to push/pull the door 85 open.

Figure 27:
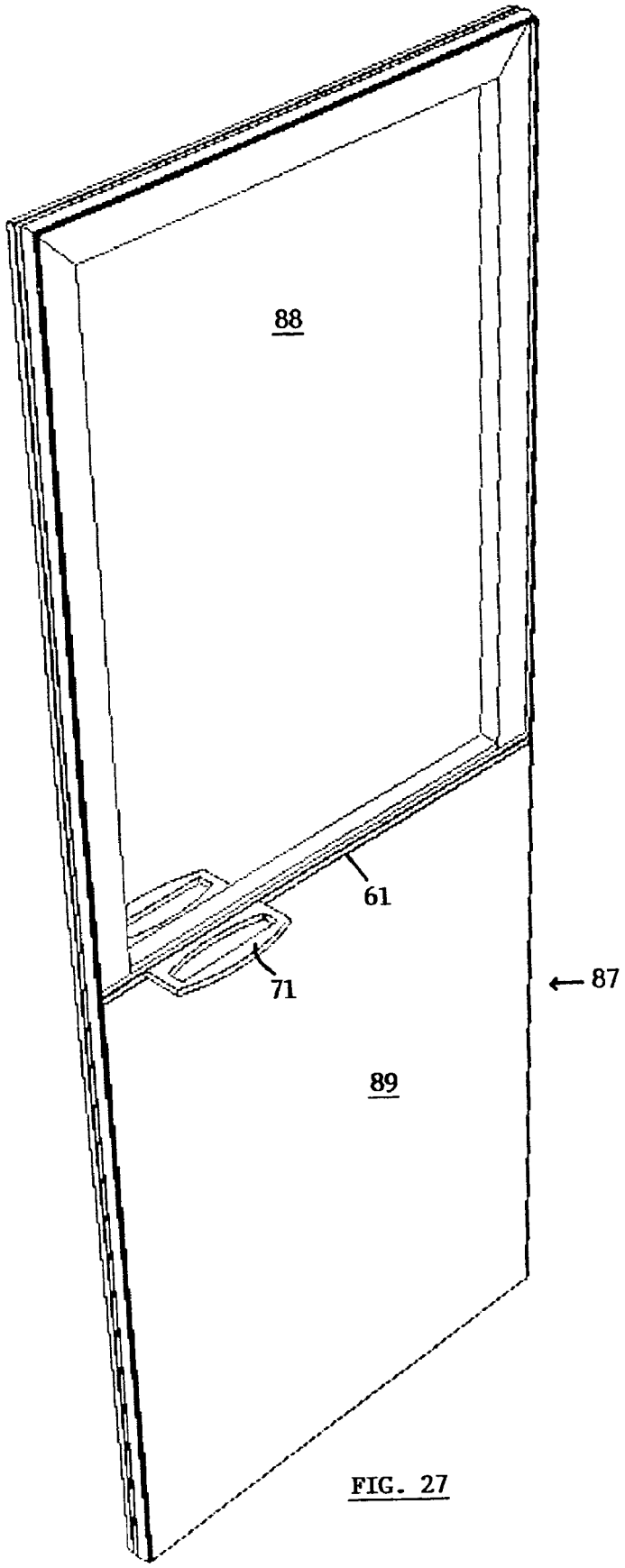
FIG. 27 shows an alternative embodiment of a door assembly according to the second aspect of the invention.

In order to illustrate the flexibility of the door panel design of the invention, FIG. 27 shows the use of the grip profile 61 of FIG. 20 in a door panel 87 with a transparent upper segment 88 and a non-transparent lower segment 89.

Figures 28A, 28B:
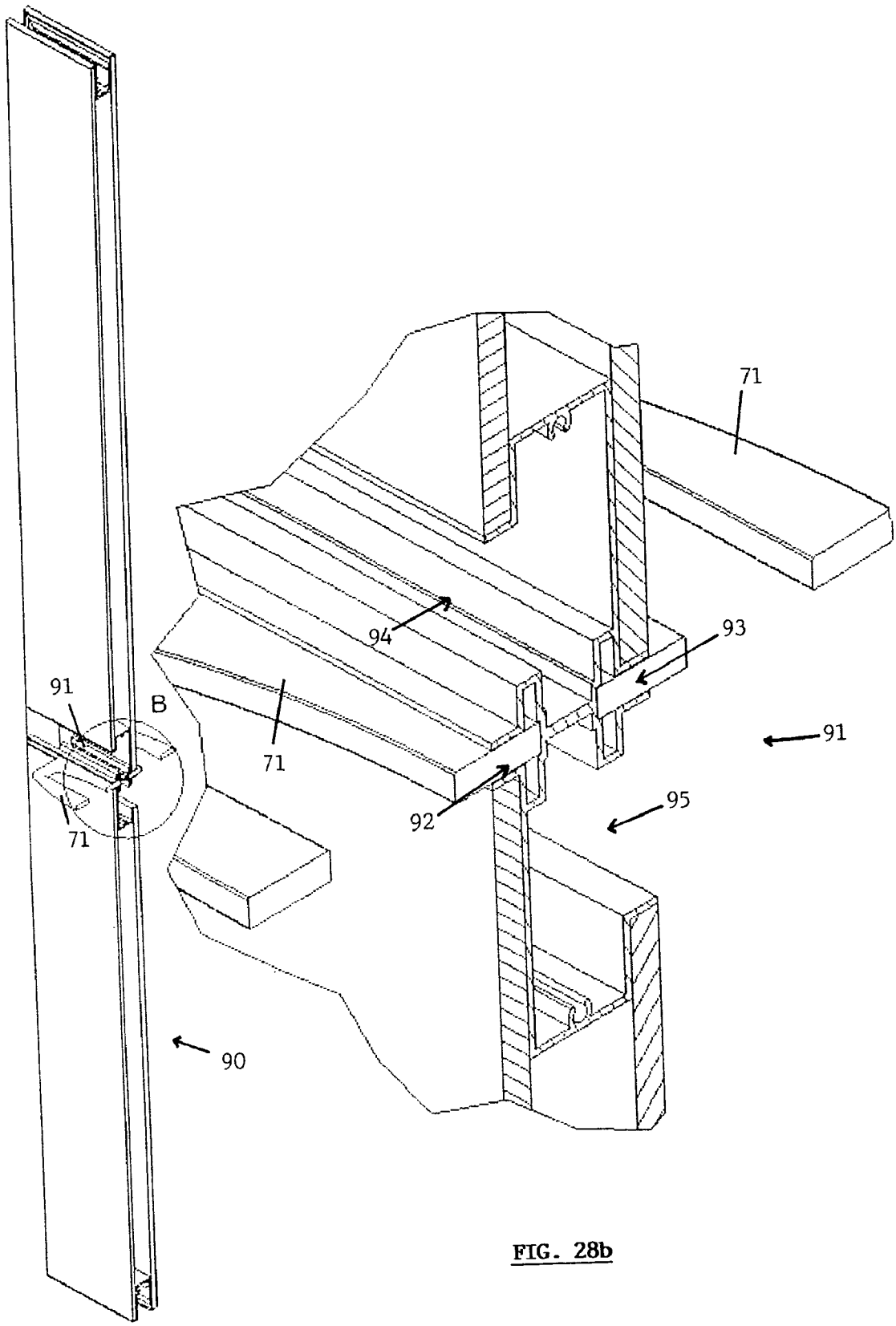
FIG. 28 shows a cross sectioned perspective view of an alternative embodiment of a door assembly according to the second aspect of the invention.

In the alternative embodiment of FIG. 28, the door panel 90 is provided with a fixing element 91 which comprises a first front opening 92 and a first back opening 93, both for receiving a releasably fixable, interchangeable grip 71 according to the same principle as has been described above with reference to FIGS. 20-22. The fixing element 91 here further comprises a second front opening 94 and a second back opening 95 where the profile of the fixing element 91 is grip-shaped according to the same principle as has been described above with reference to FIGS. 11-18. The openings 94 and 95 are fully superposed with respect to each other. In this embodiment, the user has a choice of using the interchangeable grip 71 or the grip-shaped second openings 94, 95, which further adds to the flexibility of the design of the invention.

Figure 29A:
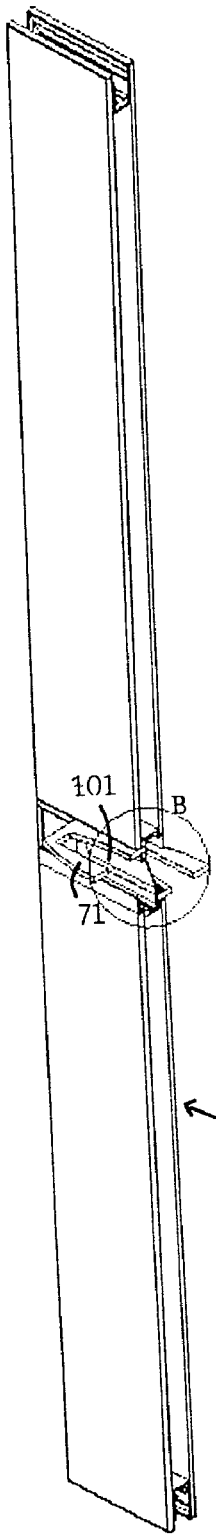
FIG. 29 shows a cross sectioned perspective view of another alternative embodiment of a door assembly according to the second aspect of the invention.
Figure 29B:
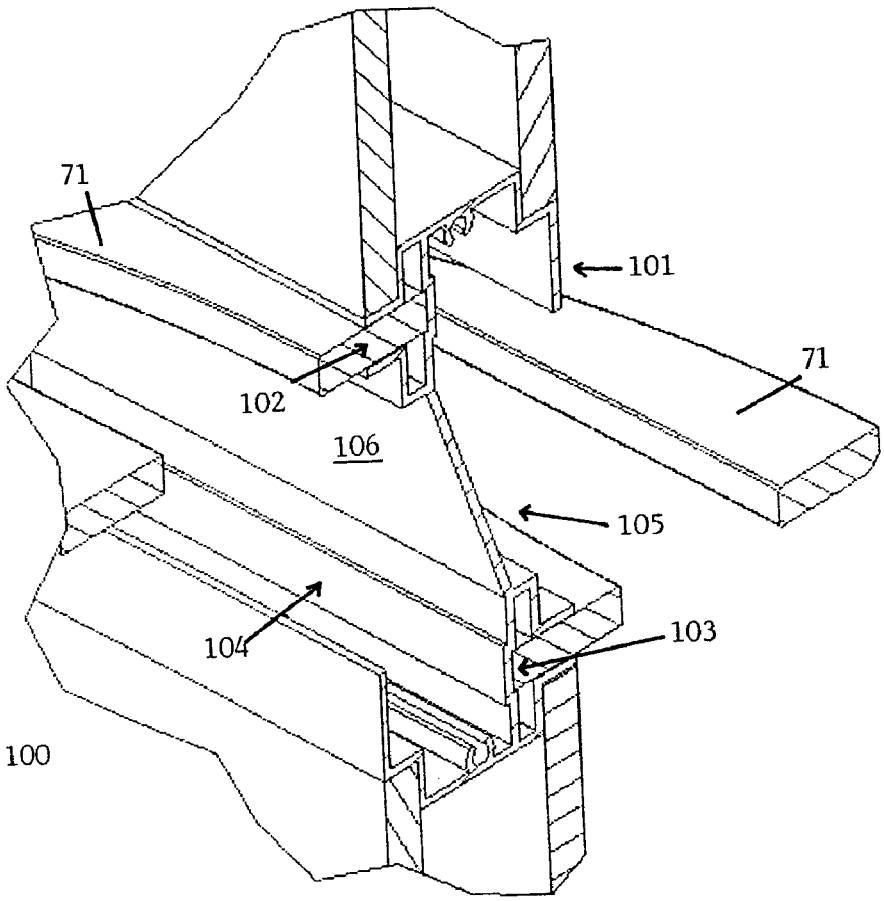

The alternative embodiment of FIG. 29 is similar to that of FIG. 28. The door panel 100 also has a fixing element 101 with first openings 102, 103 for receiving interchangeable grips 71 and second, grip-shaped openings 104, 105. The second openings 104, 105 are somewhat superposed due to a slanting middle wall 106 of the profile.

Figure 30A:
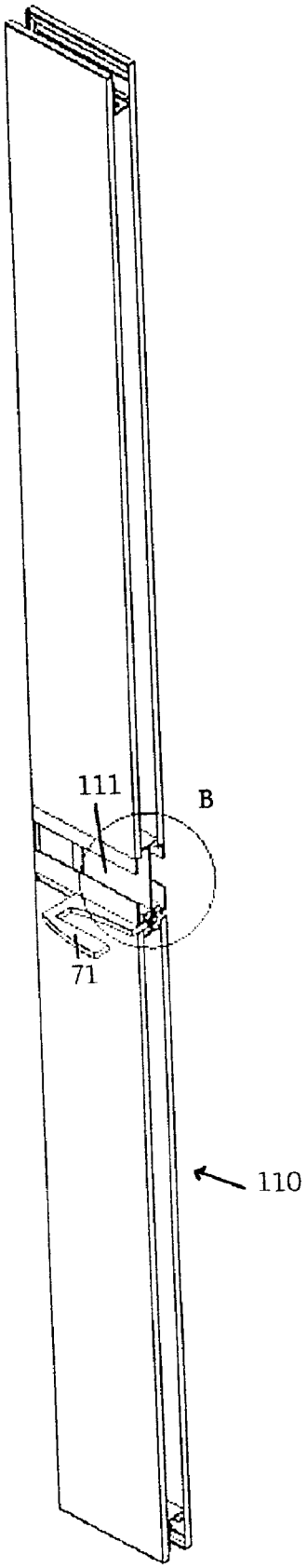
FIG. 30 shows a cross sectioned perspective view of yet another alternative embodiment of a door assembly according to the second aspect of the invention.
Figure 30B:
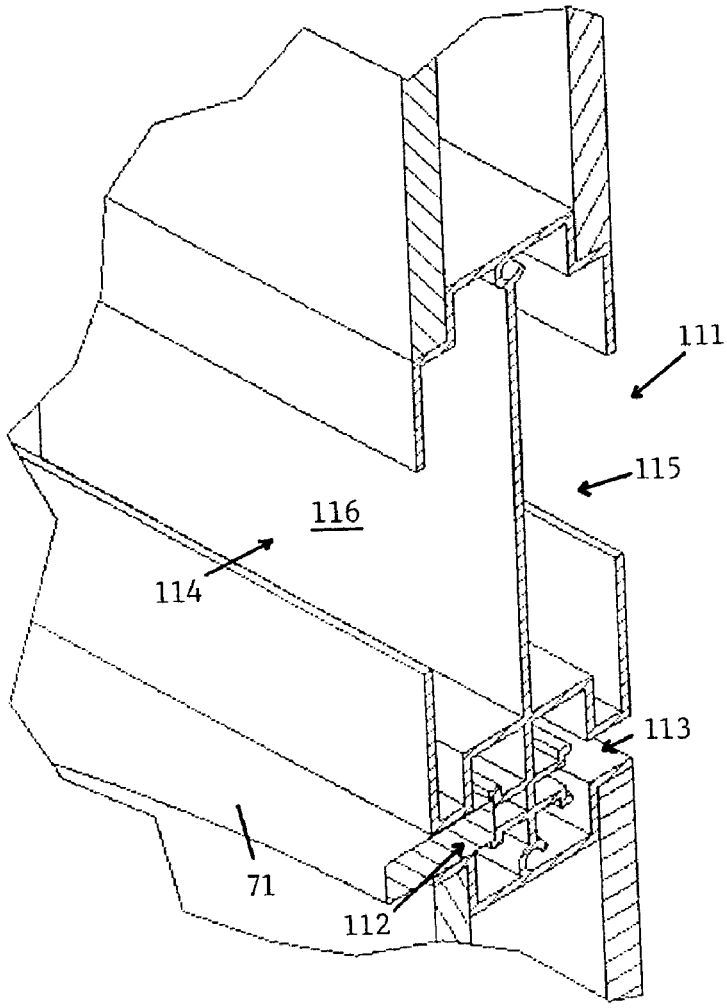

The alternative embodiment of FIG. 30 is also similar to that of FIGS. 28 and 29. The door panel 110 also has a fixing element 111 with first openings 112, 113 for receiving interchangeable grips 71 and second, grip-shaped openings 114, 115. The second openings 114, 115 are here however not superposed but located at the same height, separated by a vertical middle wall 116 of the profile.

In all of the doors described above and shown in the figures, possibly light sources (not shown) may be integrated into the profiles as an orientation or navigation aid for users or comfort light for children. The light sources can for example be LEDs or fluorescent strips, or any other light sources known to the person skilled in the art.

REFERENCE LIST

1 door
2 wall
3 handle
4 door stile
5 post
6 door
7 handle
8 wall
9 -
10 door panel
11 grip profile
12 front surface
13 back surface
14 upper door panel segment
15 lower door panel segment
16 front upper panel
17 front lower panel
18 back upper panel
19 back lower panel
20 reveal parts
21 front opening
22 back opening
23 stepped portion
24 stepped portion
25 stepped portion
26 stepped portion
27 upper part
28 lower part
29 -

30 grip profile
31 front opening
32 back opening
33 stepped portion
34 stepped portion
35 stepped portion
36 stepped portion
37 upper part
38 lower part
39 middle wall
40 door panel
41 jamb lining
42 left hand segment
43 right hand segment
44 door panel
45 door panel
46 transparent upper segment
47 non-transparent lower segment
48 bumper
49 bumper
50 grip profile
51 front opening
52 back opening
53 stepped portion
54 stepped portion
55 stepped portion
56 stepped portion
57 upper part
58 lower part
59 middle wall
60 door panel
61 fixing element
62 front surface
63 back surface
64 upper door panel segment
65 lower door panel segment
66 front upper panel
67 front lower panel
68 back upper panel
69 back lower panel
70 reveal parts
71 interchangeable grip
72 front opening
73 back opening
74 stepped portion
75 abutment part
76 recess engaging member
77 upper part
78 lower part
79 fixing screw
80 recess
81 back side
82 fixing element
83 left hand segment
84 right hand segment
85 door panel
86 jamb lining
87 door panel
88 transparent upper segment
89 non-transparent lower segment
90 door panel
91 fixing element
92 first front opening
93 first back opening
94 second front opening
95 second back opening
96 -
97 -
98 -
99 -
100 door panel
101 fixing element
102 first front opening
103 first back opening
104 second front opening
105 second back opening
106 middle wall
107 -
108 -
109 -
110 door panel
111 fixing element
112 first front opening
113 first back opening
114 second front opening
115 second back opening
116 middle wall

The invention claimed is:

1. A door comprising a door panel and a grip integrated into the door panel, wherein the door panel comprises front and back panels which are fixed together at their peripheral edges by reveal parts, the front and back panels respectively forming a front surface and a back surface of the door, wherein the door panel comprises solid front and back panels, the front and back panels respectively forming a closed front surface and a closed back surface of the door, wherein the grip extends from the front surface to the back surface of the door panel and is shaped with a gripping surface at both the front surface and the back surface of the door to enable users to open/close the door, wherein the grip is substantially straight oblong profile with a continuous cross-section which extends over substantially an entire dimension of the front and back surfaces and divides the door panel into separate door panel segments extending on opposite sides of the grip, wherein substantially no part of the grip protrudes from the front and back surfaces of the door; and wherein the profile of the grip has stepped portions at the front and back for receiving edges of the front and back panels.

2. A door according to claim 1, wherein the profile extends in horizontal direction at a predetermined height for functioning as a bumper.

3. A door according to claim 1, wherein the grip has front and back openings each of which widens towards the middle of the door panel.

4. A door according to claim 3, wherein the front and back openings are superposed with respect to each other.

5. A door according to claim 1, wherein the door is a turning door which is on one side provided with a hinge and on the other side provided with a releasable positioning element which holds the door in closed position until force is applied for opening the door.

* * * * *